US011835896B2

(12) United States Patent
Yoshida et al.

(10) Patent No.: US 11,835,896 B2
(45) Date of Patent: Dec. 5, 2023

(54) FIXING DEVICE PROVIDED WITH HEATER AND IMAGE FORMING APPARATUS

(71) Applicant: CANON KABUSHIKI KAISHA, Tokyo (JP)

(72) Inventors: Tsuguhiro Yoshida, Kanagawa (JP); Kohei Wakatsu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/882,491

(22) Filed: Aug. 5, 2022

(65) Prior Publication Data

US 2023/0067803 A1 Mar. 2, 2023

(30) Foreign Application Priority Data

Aug. 26, 2021 (JP) ..... 2021-137780

(51) Int. Cl.
*G03G 15/20* (2006.01)

(52) U.S. Cl.
CPC ..... *G03G 15/2053* (2013.01); *G03G 15/2042* (2013.01); *G03G 15/2064* (2013.01); *G03G 2215/2035* (2013.01)

(58) Field of Classification Search
CPC ..... G03G 15/2017; G03G 15/2039; G03G 15/2042; G03G 15/2046; G03G 15/2053; G03G 2215/2003
See application file for complete search history.

(56) References Cited

U.S. PATENT DOCUMENTS

2007/0182798 A1* 8/2007 Makihira ..... H05B 3/0095 347/102
2012/0230742 A1 9/2012 Nakagawa et al. .... G03G 15/20
2012/0243894 A1 9/2012 Umeda et al. ..... G03G 15/20
(Continued)

FOREIGN PATENT DOCUMENTS

JP 2017-167462 9/2017
JP 6242181 B2 12/2017
(Continued)

OTHER PUBLICATIONS

U.S. Appl. No. 17/741,345, filed May 10, 2022.
U.S. Appl. No. 17/882,455, filed Aug. 5, 2022.
U.S. Appl. No. 17/884,480, filed Aug. 9, 2022.

*Primary Examiner* — Thomas S Giampaolo, II
(74) *Attorney, Agent, or Firm* — Venable LLP

(57) ABSTRACT

A fixing device includes a substrate, a first heat generator, a second heat generator with a length in a longitudinal direction of the substrate equal to a length of the first heat generator; and a third heat generator with a length shorter than the lengths of the first and second heat generators, a soaking member with a positioning portion in the longitudinal direction. In a short side direction of the substrate, the first heat generator is arranged at one end side, the second heat generator is arranged at the other end side, and the third heat generator is arranged between the first and second heat generators. The soaking member is arranged between the heater and a holder in a thickness direction. As seen in the short side direction, the positioning portion is positioned outside of an area corresponding to the third heat generator and inside of an area corresponding to the first heat generator.

21 Claims, 13 Drawing Sheets

(56) References Cited

U.S. PATENT DOCUMENTS

| | | | | |
|---|---|---|---|---|
| 2014/0186078 | A1* | 7/2014 | Imaizumi | G03G 15/2017 399/329 |
| 2015/0139707 | A1 | 5/2015 | Suzumi et al. | G03G 15/2053 |
| 2015/0331371 | A1 | 11/2015 | Nakajima | G03G 15/20 |
| 2016/0033908 | A1 | 2/2016 | Tsunashima et al. | G03G 15/20 |
| 2016/0170351 | A1* | 6/2016 | Suzuki | G03G 15/2042 399/329 |
| 2016/0327894 | A1 | 11/2016 | Tsunashima et al. | G03G 15/20 |
| 2016/0342117 | A1 | 11/2016 | Minamishima et al. | G03G 15/20 |
| 2017/0060052 | A1 | 3/2017 | Narahara et al. | G03G 15/20 |
| 2017/0102651 | A1* | 4/2017 | Tanaka | G03G 15/2053 |
| 2017/0315485 | A1 | 11/2017 | Tsunashima et al. | G03G 15/20 |
| 2017/0343929 | A1 | 11/2017 | Narahara et al. | G03G 15/20 |
| 2018/0074444 | A1 | 3/2018 | Wakatsu et al. | G03G 15/20 |
| 2018/0074445 | A1 | 3/2018 | Nishida et al. | G03G 15/20 |
| 2018/0173140 | A1 | 6/2018 | Imaizumi et al. | G03G 15/20 |
| 2018/0181039 | A1 | 6/2018 | An et al. | G03G 15/20 |
| 2018/0348676 | A1* | 12/2018 | Kume | G03G 15/206 |
| 2018/0348678 | A1 | 12/2018 | Nakamoto et al. | G03G 15/20 |
| 2018/0373189 | A1 | 12/2018 | Wakatsu et al. | G03G 15/20 |
| 2019/0171145 | A1 | 6/2019 | Imaizumi et al. | G03G 15/20 |
| 2020/0233346 | A1 | 7/2020 | Sato et al. | G03G 15/20 |
| 2020/0233348 | A1 | 7/2020 | Nakajima et al. | G03G 15/20 |
| 2020/0233350 | A1 | 7/2020 | Oi et al. | G03G 15/20 |
| 2020/0233352 | A1 | 7/2020 | Doda et al. | G03G 15/2053 |
| 2020/0249600 | A1 | 8/2020 | Yoshida et al. | G03G 15/20 |
| 2020/0301330 | A1 | 9/2020 | Yoshida et al. | G03G 15/20 |
| 2020/0371459 | A1 | 11/2020 | Takeda et al. | G03G 15/20 |
| 2021/0063923 | A1 | 3/2021 | Odate et al. | G03G 15/20 |
| 2021/0072680 | A1 | 3/2021 | Yoshida et al. | G03G 15/20 |
| 2021/0072684 | A1 | 3/2021 | Doda et al. | G03G 15/20 |
| 2021/0132528 | A1 | 5/2021 | Sato et al. | G03G 15/20 |
| 2021/0165351 | A1 | 6/2021 | Doda et al. | G03G 15/20 |
| 2021/0232072 | A1 | 7/2021 | Nakajima et al. | G03G 15/20 |
| 2021/0278793 | A1 | 9/2021 | Maeda et al. | G03G 15/00 |
| 2021/0278794 | A1 | 9/2021 | Nakajima | G03G 15/00 |
| 2021/0333732 | A1 | 10/2021 | Yoshida et al. | G03G 15/20 |
| 2021/0333733 | A1 | 10/2021 | Doda et al. | G03G 15/20 |
| 2022/0057736 | A1 | 2/2022 | Doda et al. | G03G 15/20 |
| 2022/0100128 | A1 | 3/2022 | Nakamoto et al. | G03G 15/20 |
| 2022/0253006 | A1 | 8/2022 | Doda et al. | G03G 15/20 |
| 2022/0299912 | A1 | 9/2022 | Yoshida et al. | G03G 15/20 |
| 2022/0299914 | A1 | 9/2022 | Doda | G03G 15/20 |
| 2022/0308509 | A1 | 9/2022 | Wakatsu et al. | G03G 15/20 |

FOREIGN PATENT DOCUMENTS

| | | |
|---|---|---|
| JP | 2020-034940 | 3/2020 |
| JP | 2020-115186 | 7/2020 |
| JP | 2020-115189 | 7/2020 |

* cited by examiner

FIXING DEVICE PROVIDED WITH HEATER AND IMAGE FORMING APPARATUS

FIELD OF THE INVENTION AND RELATED ART

The present invention relates to a fixing device and an image forming apparatus which is provided with the fixing device.

Conventionally, the image forming apparatus is provided with the fixing device to fix a toner image on a recording material by heating and pressurizing the toner image which is transferred onto the recording material. And some fixing devices include a plurality of heating members of different lengths to heat the recording material according to a width of the recording material. For example, a following constitution of the fixing device which is provided with a plurality of heating members of different lengths in a longitudinal direction is disclosed in Japanese Laid-Open Patent Application (JP-A) 2020-115189. In the fixing device disclosed in JP-A 2020-115189, in order to suppress thermal deformation of a heater board, long heating members in a longitudinal direction are arranged symmetrically with respect to a center in a lateral direction in vicinities of both end portions of the heater board in the lateral direction, while a short heating member in the longitudinal direction is arranged between the long heating members in the longitudinal direction. Further, for example, a constitution, which reduces temperature non-uniformity of the heater board by arranging a soaking member, whose thermal conductivity is high, on a back surface of the heating board, is proposed, for example, in Japanese Patent 6242181.

In a constitution in which the soaking member such as an aluminum plate, for example, is arranged to contact the heater board to reduce temperature non-uniformity of the heater which is a heating member, a positioning portion may be provided on the soaking member in order to fix the soaking member to a heater holder which holds a heater. The positioning portion is formed by a process such as bending a portion of the aluminum plate which is used as a soaking member, for example, and a position of the soaking member is fixed by fitting the bent portion into a recessed portion which is formed in the heater holder.

In this case, heat capacity of the bent portion which is the positioning portion, is greater than that of a portion in which bending process is not performed, since volume of the soaking member becomes larger. As a result, since a region of the heater board which is opposed to the positioning portion of the soaking member is less likely to rise in temperature than other regions which do not include the positioning portion, a region in which temperature is different in the heater board is created and temperature gradient occurs locally, then the heater board may be deformed.

SUMMARY OF THE INVENTION

According to an aspect of the present invention, there is provided a fixing device for fixing an unfixed toner image on a recording material to the recording material, the fixing device comprising, a heater provided with an elongated substrate, a first heat generating member, a second heat generating member of which a length in a longitudinal direction of the substrate is substantially equal to a length of the first heat generating member; and a third heat generating member of which a length in the longitudinal direction is shorter than the lengths of the first heat generating member and the second heat generating member, a soaking member configured to uniformalize a temperature of the substrate, and a holder configured to hold the heater and the soaking member, wherein the first heat generating member, the second heat generating member and the third heat generating member are arranged on the substrate, wherein, with respect to a short side direction of the substrate perpendicular to the longitudinal direction of the substrate and a thickness direction of the substrate, the first heat generating member is arranged at one end side, the second heat generating member is arranged at the other end side, and the third heat generating member is arranged between the first heat generating member and the second heat generating member, wherein the soaking member is arranged between the heater and the holder with respect to the thickness direction of the substrate, wherein the soaking member includes a positioning portion to position the holder with respect to the longitudinal direction of the soaking member, wherein, as seen in the short side direction, the positioning portion is positioned outside of an area corresponding to the third heat generating member and at least a part of the positioning portion is positioned inside of an area corresponding to the first heat generating member.

Further features of the present invention will become apparent from the following description of exemplary embodiments with reference to the attached drawings.

Figure 4:
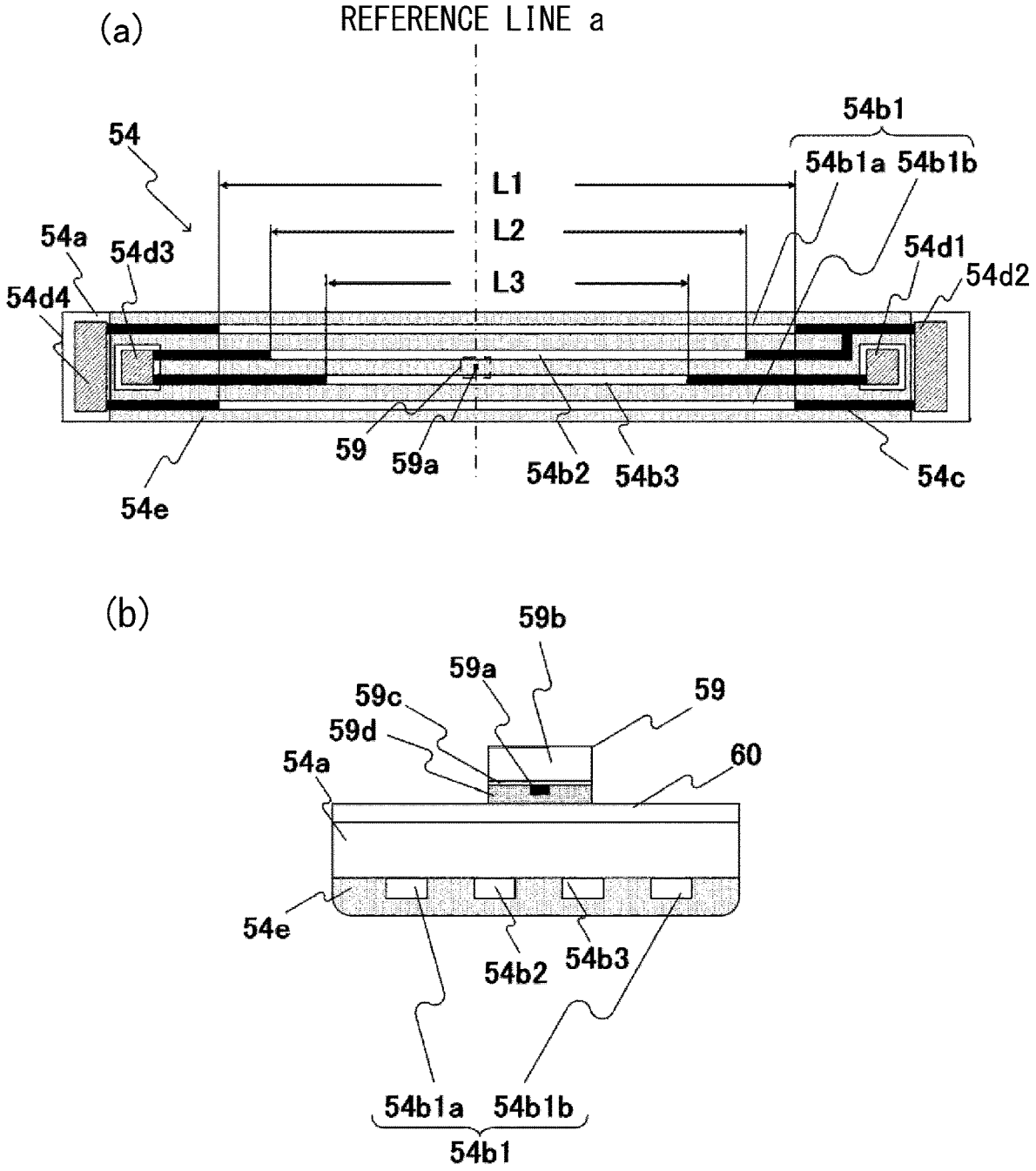

Part (a) and part (b) of FIG. 4 are schematic views illustrating a constitution of a heater according to the first embodiment and the second embodiment.

Figure 5:
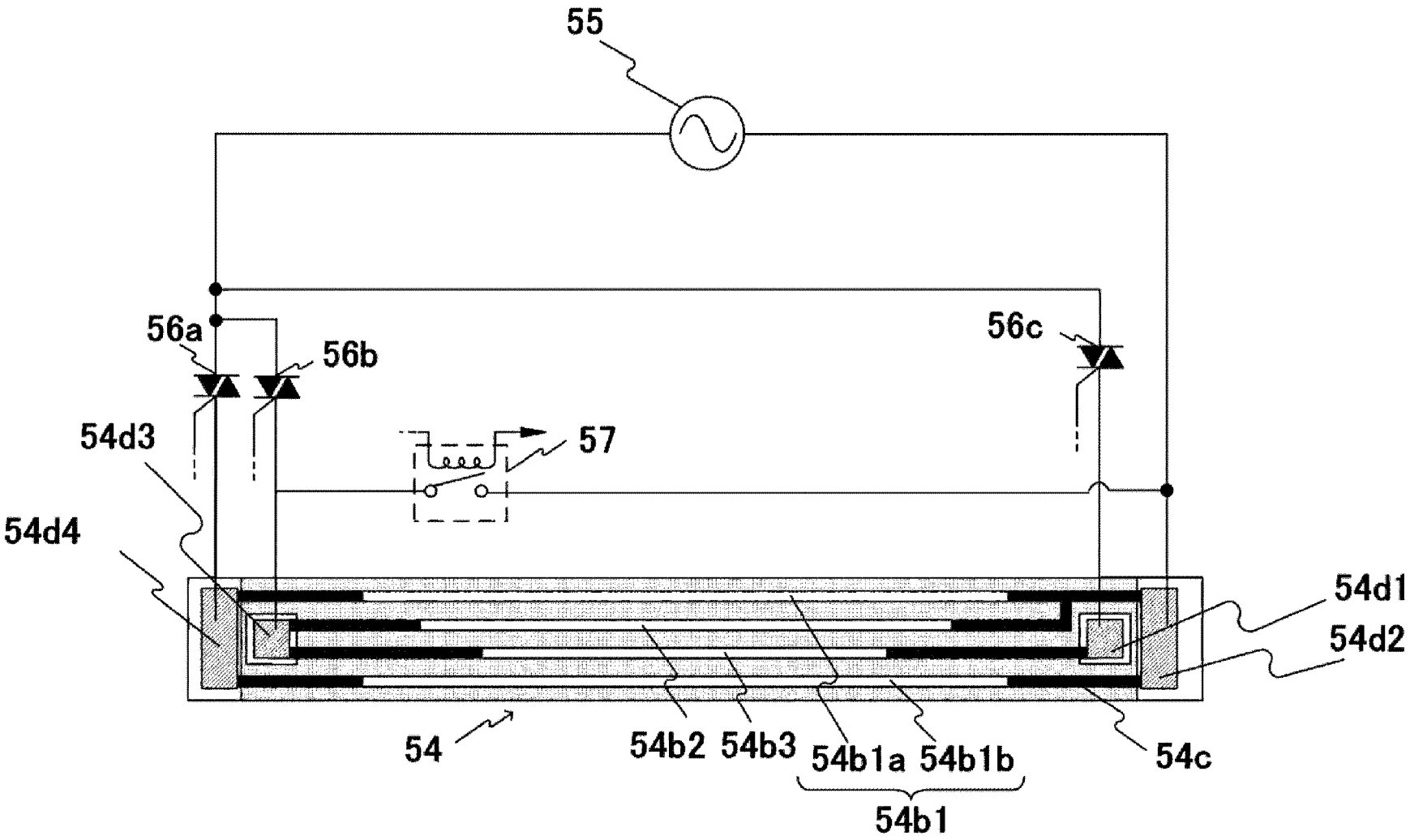

FIG. 5 is a circuit schematic view of a power control circuit according to the first embodiment.

Figure 6:
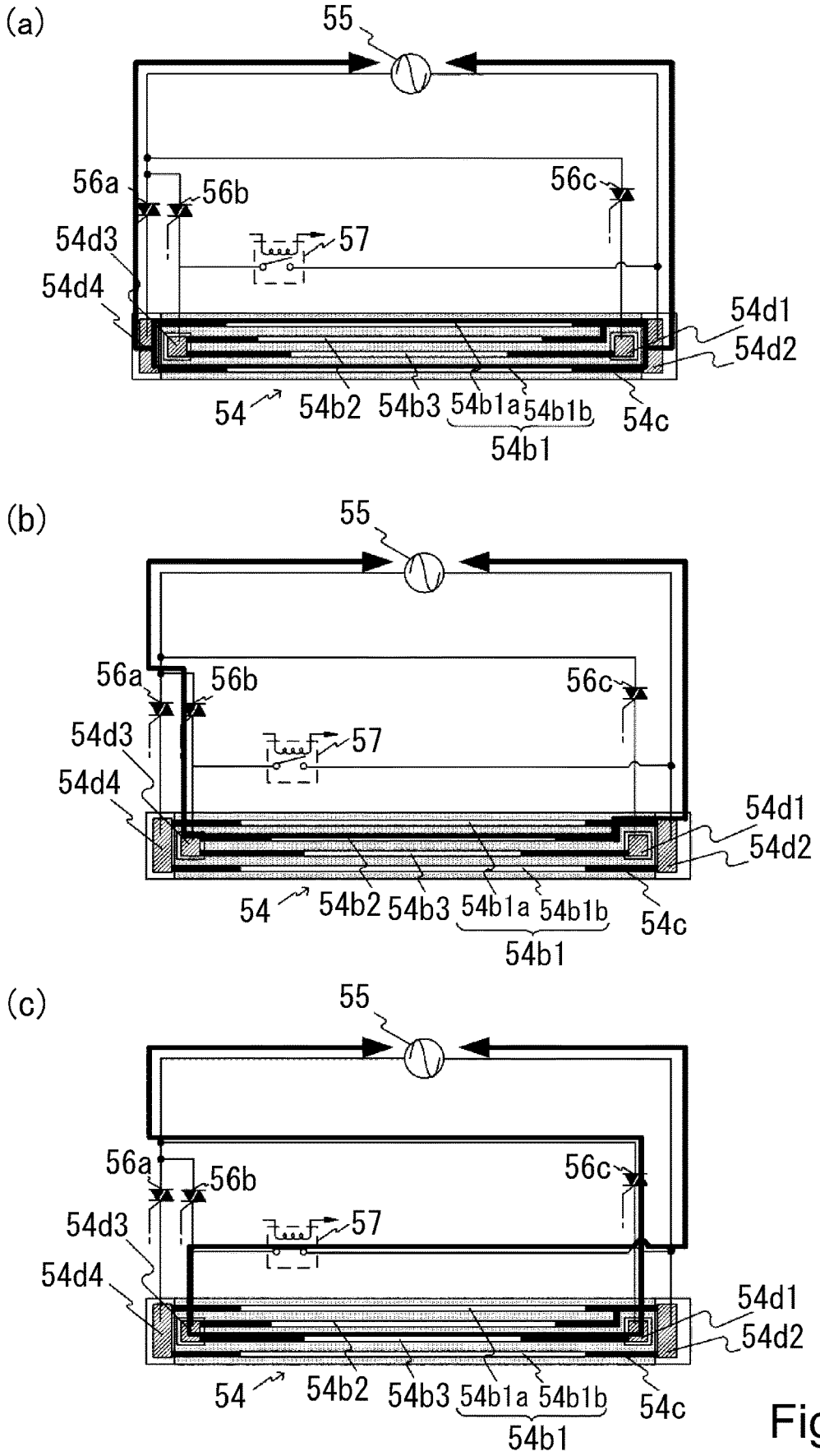

Part (a), part (b) and part (c) of FIG. 6 are schematic views illustrating a current path to a heating member according to the first embodiment.

Figure 7:
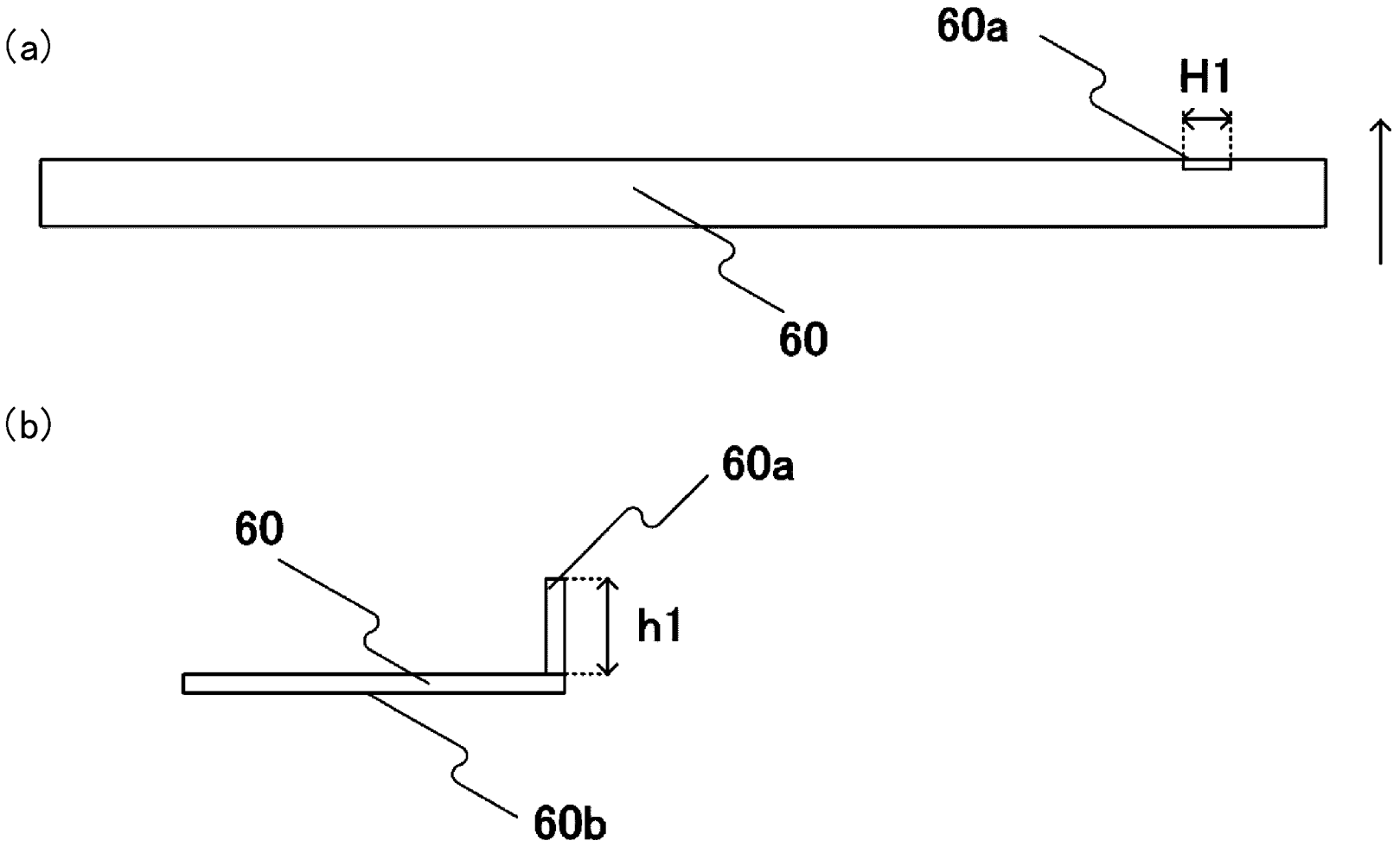

Part (a) and part (b) of FIG. 7 are schematic views showing a constitution of a soaking member according to the first embodiment.

Figure 8:
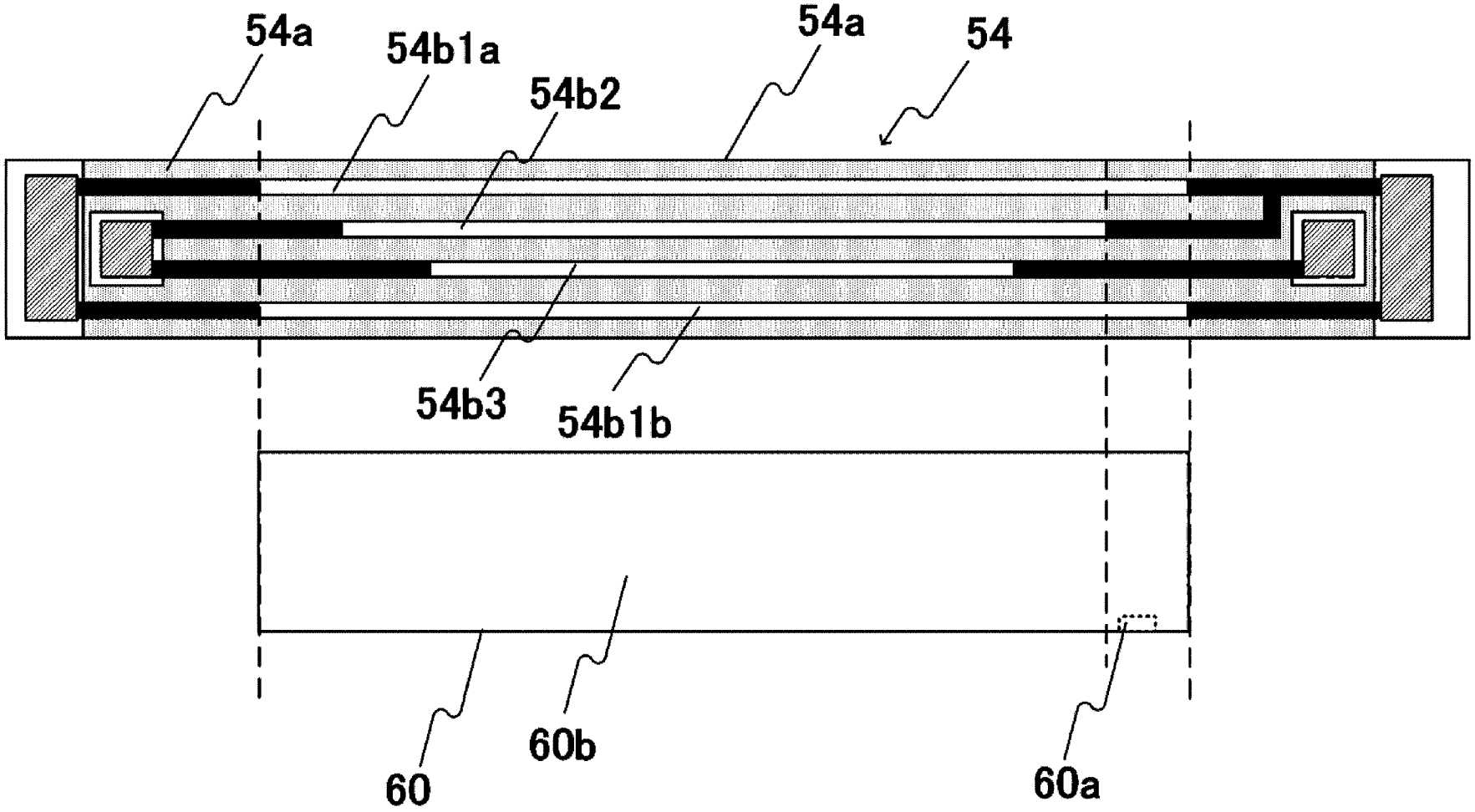

FIG. 8 is a view illustrating a positional relationship between a positioning portion of the soaking member and the heating member according to the first embodiment.

Figure 9:
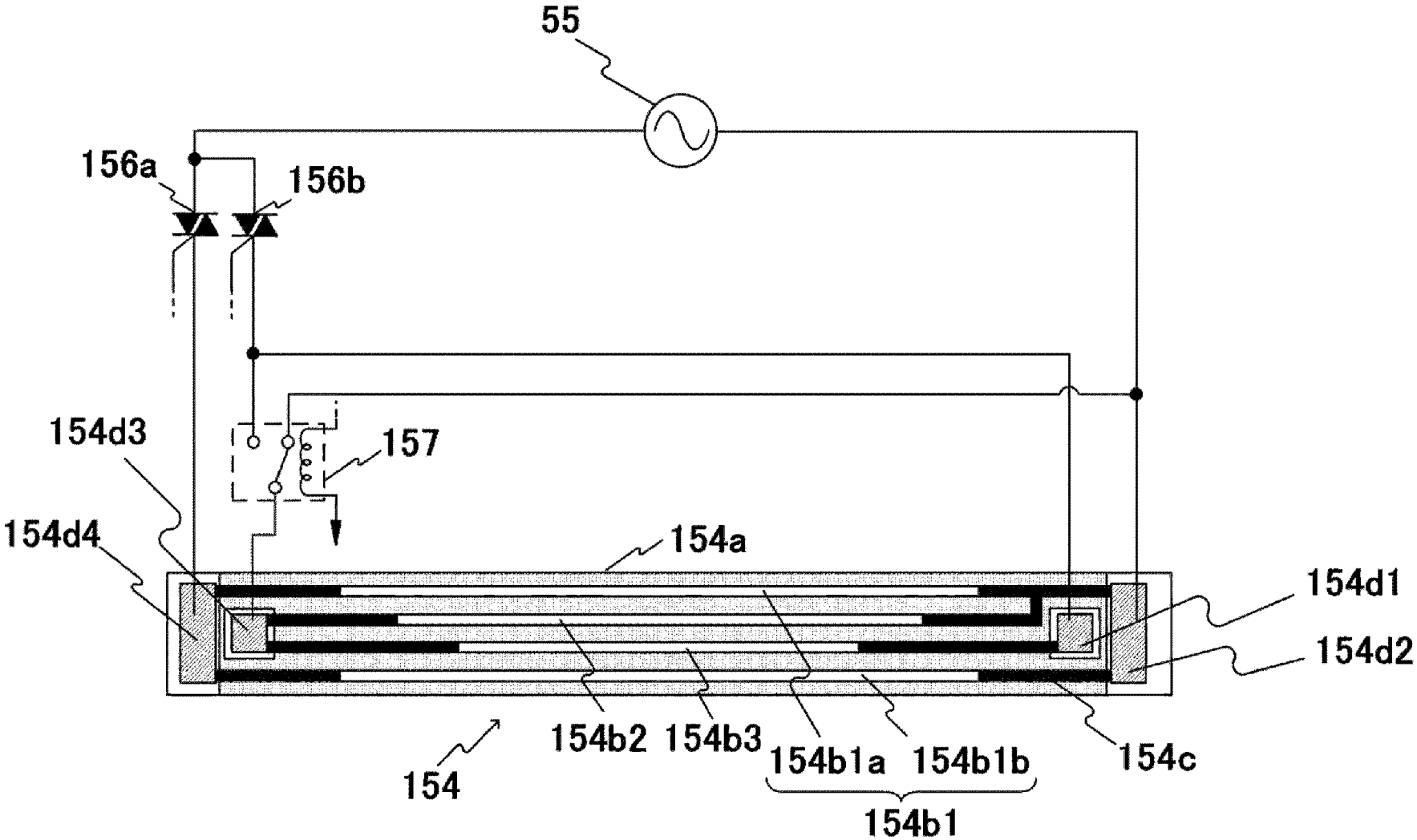

FIG. 9 is a circuit schematic view of a power control circuit according to the second embodiment.

Figure 10:
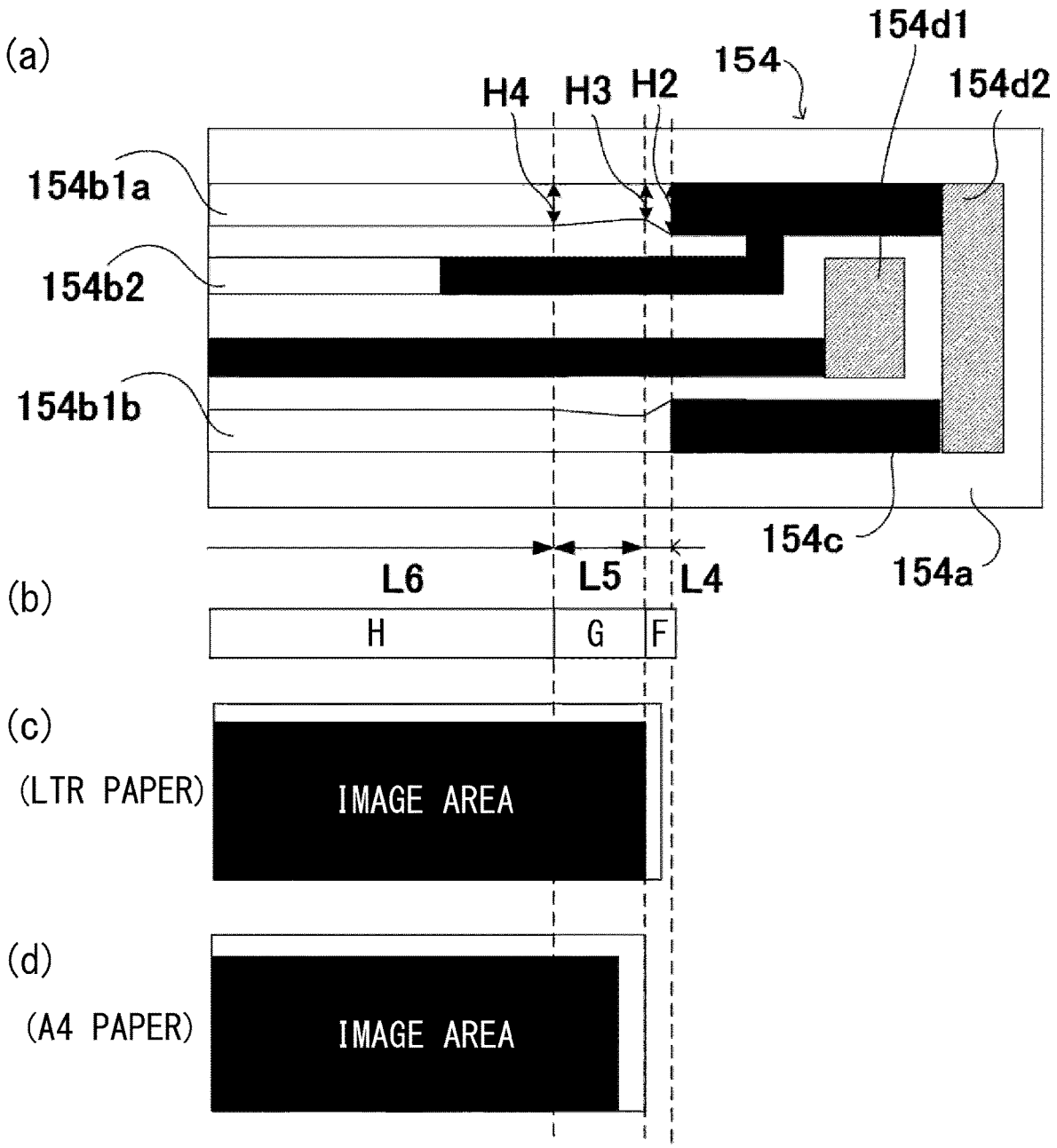

Part (a), part (b), part (c) and part (d) of FIG. 10 are diagrams illustrating a constitution of the heating member according to the second embodiment.

Figure 11:
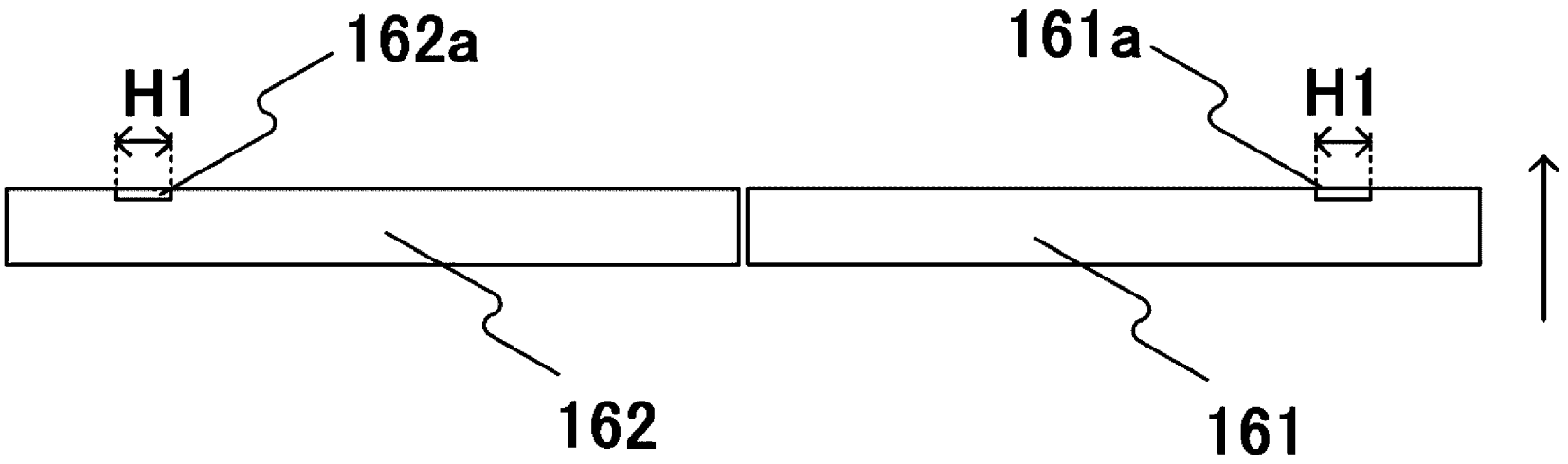

FIG. 11 is a schematic view showing a constitution of the soaking member according to the second embodiment.

Figure 12:
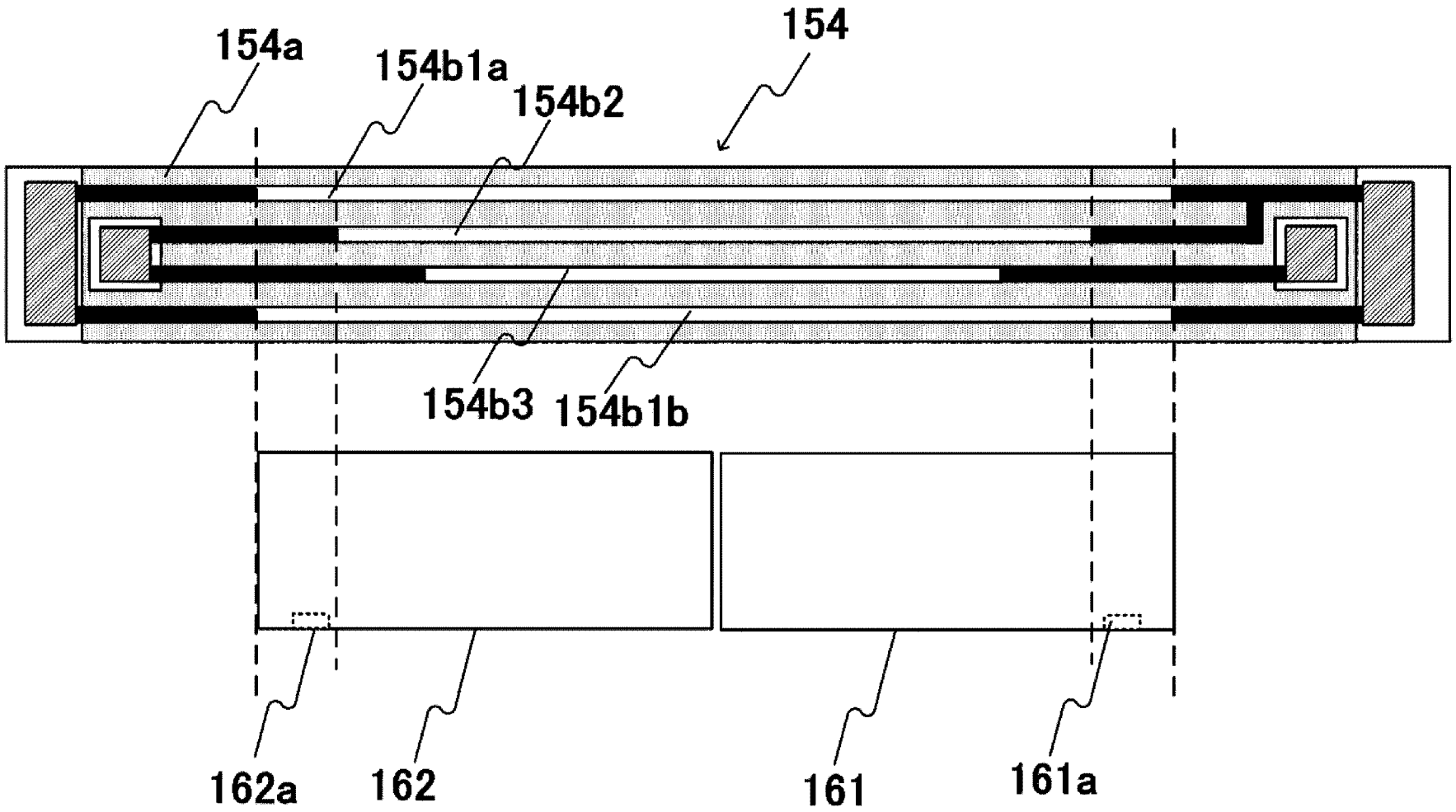

FIG. 12 is a view illustrating a positional relationship between the positioning portion of the soaking member and the heating member according to the second embodiment.

Figure 13:
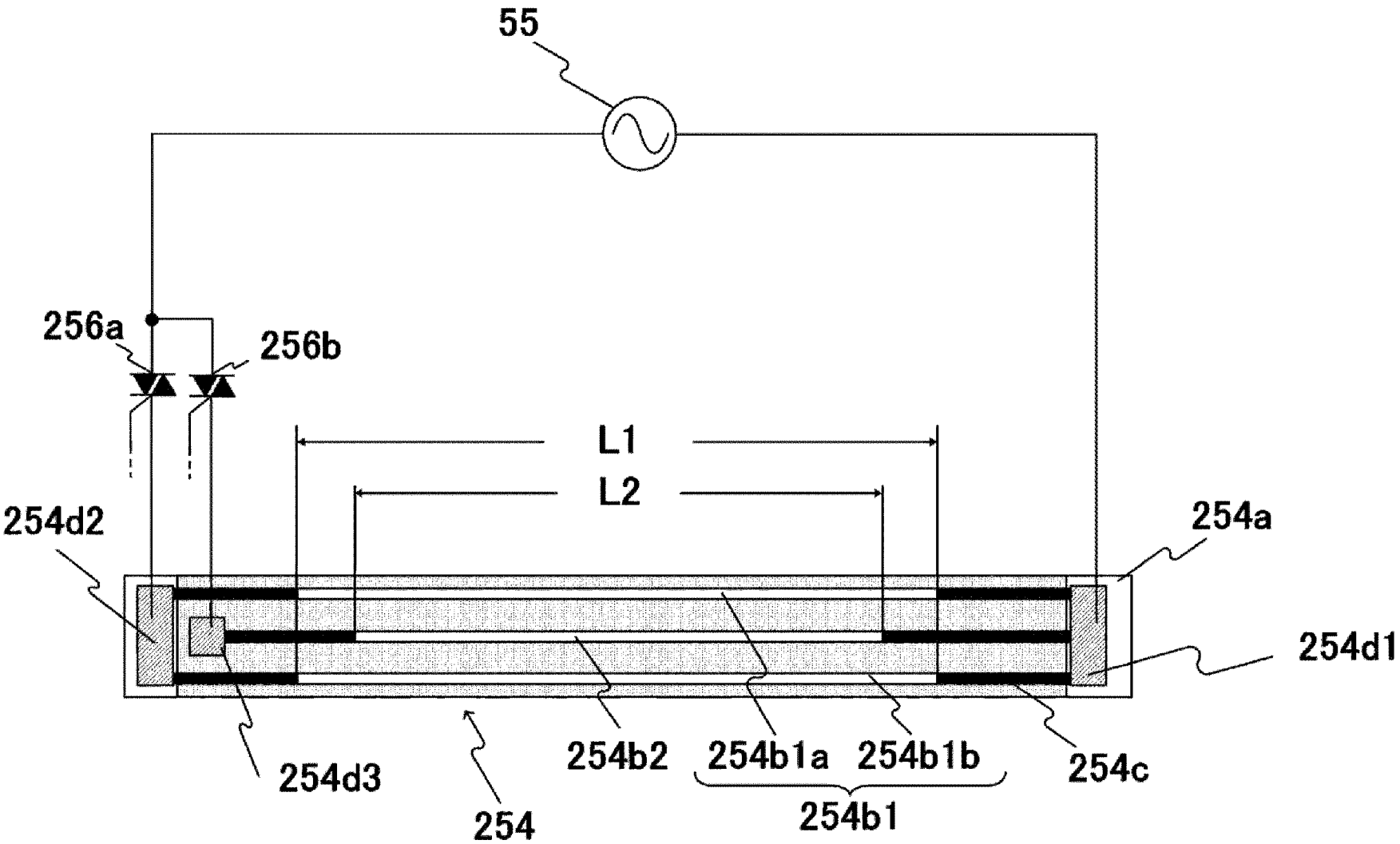

FIG. 13 is a circuit schematic view of the power control circuit according to the third embodiment.

DESCRIPTION OF THE EMBODIMENTS

In the following, embodiments of the present invention will be specifically described with reference to Figures. In the following embodiments, passing a recording material through a fixing nip portion of the fixing device is referred to as passing sheet.

First Embodiment

[Overall Constitution of the Image Forming Apparatus]

Figure 1:
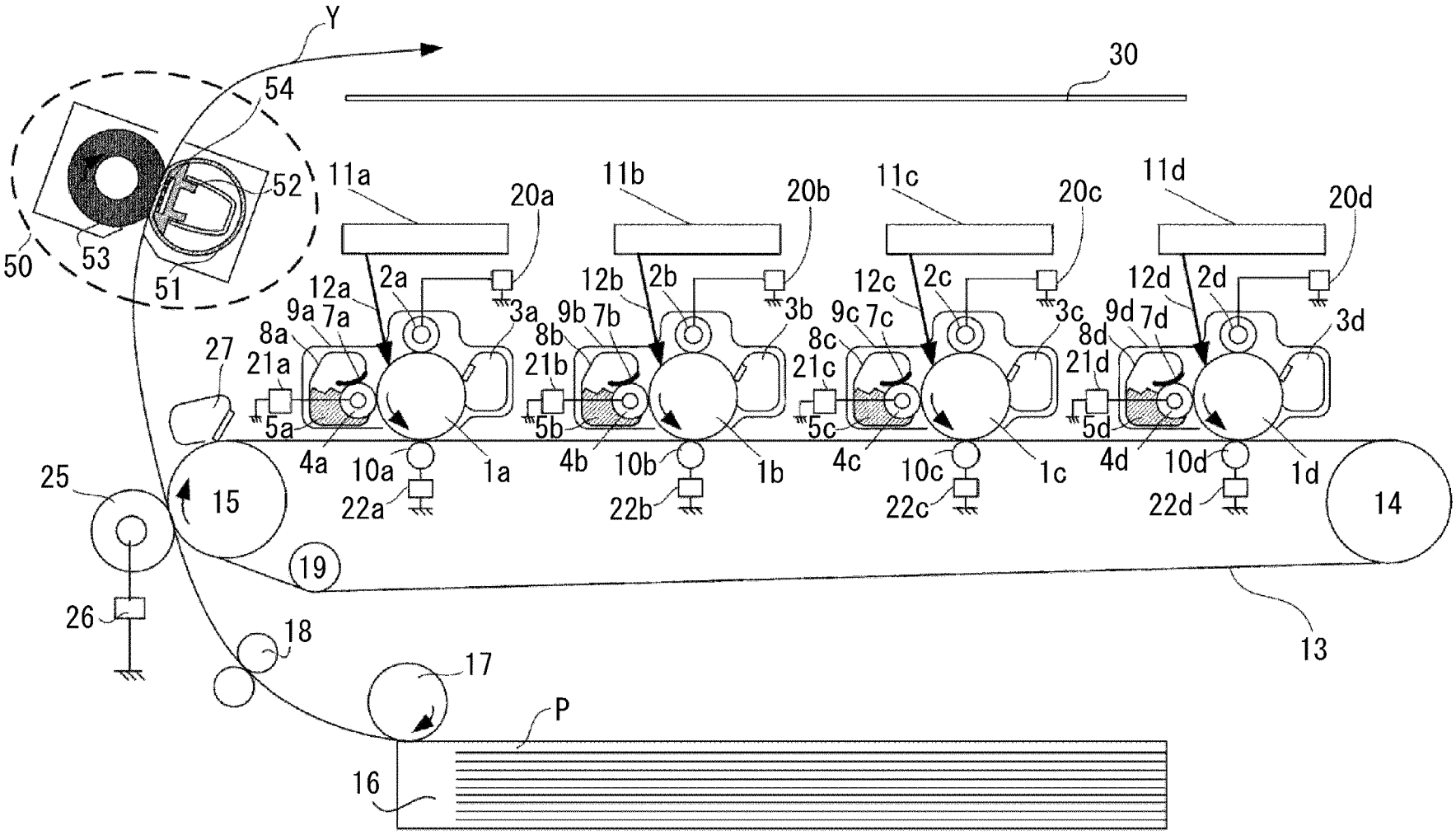
FIG. 1 is a sectional view showing a constitution of an image forming apparatus according to a first embodiment, a second embodiment and a third embodiment.

FIG. 1 is the sectional view showing the constitution of the inline system color image forming apparatus, which is the image forming apparatus on which the fixing device of the first embodiment is mounted. The constitution of the electrophotographic color image forming apparatus will be described by using FIG. 1. Incidentally, a first station is a station for toner image forming of yellow (Y) color, and a second station is a station for toner image forming of magenta (M) color. Further, a third station is a station for toner image forming of cyan (C) color, and a fourth station is a station for toner image forming of black (K) color.

In the first station, a photosensitive drum 1*a*, which is an image bearing member, is an OPC photosensitive drum. The photosensitive drum 1*a* is constituted of multiple layers in which functional organic materials which include a carrier generating layer which generates an electric charge by exposing light on metal cylinder, an electric charge transporting layer which transports the generated electric charge, etc., are layered, and an outermost layer of the photosensitive drum 1*a* is low in an electrical conductivity and is substantially insulated. A charging roller 2*a*, which is a charging unit, is abutted with the photosensitive drum 1*a*, and as the photosensitive drum 1*a* rotates, the charging roller 2*a* is rotationally driven and uniformly charges a surface of the photosensitive drum 1*a*. A voltage, in which a DC voltage or an AC voltage is superimposed, is applied to the charging roller 2*a*, and from a nip portion between the charging roller 2*a* and the surface of the photosensitive drum 1*a*, an electric discharge is generated in minute air gaps in an upstream side and a downstream side of the photosensitive drum 1*a* with respect to a rotational direction. In this way, the photosensitive drum 1*a* is charged. A cleaning unit 3*a* cleans a remaining toner on the photosensitive drum 1*a* after a primary transfer which will be described below. A developing unit 8*a*, which is a developing unit, accommodates a nonmagnetic single-component toner 5*a*, and includes a developing roller 4*a* and a developer application blade 7*a*. The photosensitive drum 1*a*, the charging roller 2*a*, the cleaning unit 3*a*, and the developing unit 8*a* are accommodated in an integrated process cartridge 9*a* (image forming portion) which is dismountable from the image forming apparatus.

An exposure device 11*a*, which is an exposure unit, is constituted of a scanner unit which reflects a laser beam by a rotatable polygon mirror and scans the surface of the photosensitive drum 1*a*, or a LED (light emitting diode) array, and emits a scanning beam 12*a* which is modulated according to an image signal onto the photosensitive drum 1*a*. Further, the charging roller 2*a* is connected to a charging high voltage source 20*a* which is a voltage supplying unit to the charging roller 2*a*. The developing roller 4*a* is connected to a developing high voltage source 21*a* which is a voltage supplying unit to the developing roller 4*a*. A primary transfer roller 10*a* is connected to a primary transfer high voltage source 22*a* which is a voltage supplying unit to the primary transfer roller 10*a*. A constitution of the first station is described above, and the second station, the third station and the fourth station include the same constitution. For the second station, the third station and the fourth station, a part which has a same function as the first station is attached with a same reference numeral, and a subscript of the reference numeral is attached with b, c and d for each station. Incidentally, in a description below, the subscripts of a, b, c and d are omitted except a case that a specific station is described.

An intermediary transfer belt 13 is supported by three rollers of a secondary transfer opposing roller 15, a tension roller 14, and an auxiliary roller 19 as stretching members of the intermediary transfer belt 13. A force in a direction of stretching the intermediary transfer belt 13 by a spring (not shown) is applied to only the tension roller 14 and an appropriate tension force to the intermediary transfer belt 13 is maintained. The secondary transfer opposing roller 15 rotates by receiving a rotational drive from a main motor 99 (see FIG. 2), and the intermediary transfer belt 13, which is wound around an outer periphery 13 of the secondary transfer opposing roller 15, rotates. The intermediary transfer belt 13 moves at a substantially same speed in an arrow direction (for example, in a clockwise direction in FIG. 1) with respect to the photosensitive drums from 1*a* through 1*d* (for example, in a counterclockwise direction in FIG. 1). Further, the primary transfer roller 10 is arranged at a position which is opposed to the photosensitive drum 1 across the intermediary transfer belt 13 and is rotationally driven along with the movement of the intermediary transfer belt 13. A position, in which the photosensitive drum 1 is abutted with the primary transfer roller 10 across the intermediary transfer belt 13, is referred as a primary transfer position. The auxiliary roller 19, the tension roller 14 and the secondary transfer opposing roller 15 are electrically grounded. Incidentally, the primary transfer rollers from 10*b* through 10*d* in the second station, the third station and the fourth station have same constitutions as the primary transfer roller 10*a* in the first station, so descriptions are omitted.

Next, an image forming operation of the image forming apparatus which is shown in FIG. 1 will be described below. When the image forming apparatus receives a print command during a standby state, it starts the image forming operation. The photosensitive drum 1, the intermediary transfer belt 13, etc. start to rotate at a predetermined process speed in a direction of an arrow in the figure by the main motor 99 (see FIG. 2). The photosensitive drum 1*a* is uniformly charged by the charging roller 2*a* to which a charging voltage is applied by the charging high voltage source 20*a*, and then, an electrostatic latent image is formed by the scanning beam 12*a* which is emitted from the exposure device 11*a* according to image information. The toner 5*a* in the developing unit 8*a* is negatively charged by the developer application blade 7*a* and applied to the developing roller 4*a*. And a predetermined developing voltage is applied to the developing roller 4*a* by the developing high voltage source 21*a*. When the photosensitive drum 1*a* rotates and the electrostatic latent image which is formed on the photosensitive drum 1*a* reaches the developing roller 4*a*, the electrostatic latent image is visualized by adhesion of the negative polarity toner and a toner image of a first color (for example, Y (yellow)) is formed on the photosensitive drum 1*a*. Each station of other colors of M (magenta), C (cyan) and K (black) also operate in the same way. At a timing corresponding to a distance between primary transfer positions of each color, while delaying a writing signal from a controller (not shown), the electrostatic latent image is formed on each of the photosensitive drums from 1*a* through 1*d* by the canning beams from 12*a* through 12*d* from the exposure devices from 11*a* through 11*d*. To each of the primary transfer rollers from 10*a* through 10*d*, a DC high voltage of an opposite polarity to the toner is applied from the primary transfer high voltage source from 22*a* through 22*d*. As a result, the toner images on the photosensitive drums from 1*a* through 1*d* are transferred to the intermediary transfer belt 13 sequentially (hereinafter referred to as primary transfer), and a multiple toner image is formed on the intermediary transfer belt 13.

After that, in accordance with the toner image formation, a paper P, which is a recording material stacked in a cassette 16 (paper feeding portion), is fed to a feeding passage Y by a feeding roller 17, which is rotationally driven by a paper feeding solenoid (not shown). The fed paper P is fed to a registration roller 18 (hereinafter referred to as registration roller) by a feeding roller (not shown). The paper P is synchronized with the toner image on the intermediary transfer belt 13 and is fed to a transfer nip portion in which the intermediary transfer belt 13 is abutted with the secondary transfer roller 25 by the registration roller 18. A voltage of opposite polarity to the toner is applied to the secondary transfer roller 25 by the secondary transfer high voltage source 26, and a four color multiple toner image which is born on the intermediary transfer belt 13 is transferred to the paper P (on the recording material) at one time (hereinafter referred to as secondary transfer). On the other hand, after secondary transfer is completed, a remaining toner on the intermediary transfer belt 13 is cleaned by a cleaning unit 27. After the secondary transfer is completed, the paper P is fed to the fixing device 50 which is a fixing unit, and the paper P, on which the toner image is fixed, is discharged to a discharge tray 30 as an image forming article (print, copy). A time from a start of the image forming operation until reaching of the paper P to the fixing nip portion N (see FIG. 3) which will be described below, is approximately 9 seconds, for example, and a time from a start of the image forming operation until discharging of the paper P is approximately 12 seconds, for example. Incidentally, a fixing film 51, a heater holder 52, a pressing roller 53, and a heater 54 of the fixing device 50 will be described below.

A printing mode in which images are printed continuously on a plurality of sheets of paper P is hereafter referred to as continuous printing or continuous job. In continuous printing, an interval between a trailing end of a preceding sheet of paper P which is printed precedingly (hereinafter referred to as preceding sheet) and a leading end of a subsequent sheet of paper P (hereinafter referred to as subsequent sheet) which is printed after the preceding sheet, is referred to as sheet interval. In the embodiment, in continuous printing of A4 size paper P, the toner image on the intermediary transfer belt 13 and the paper P are synchronized and fed, so that a distance of the sheet interval is set to be, for example, 30 mm, and printing is performed. The image forming apparatus in the embodiment is a center based image forming apparatus which performs printing operation by aligning a center position of each member with respect to a direction perpendicular to a feeding direction of the paper P (longitudinal direction which will be described below). Thus, a center position of each sheet of paper P is same even when a printing operation is for paper P with a larger length with respect to a direction perpendicular to a feeding direction or a printing operation is for paper P with a smaller length with respect to the direction perpendicular to the feeding direction.

[Control Block of the Image Forming Apparatus]

Figure 2:
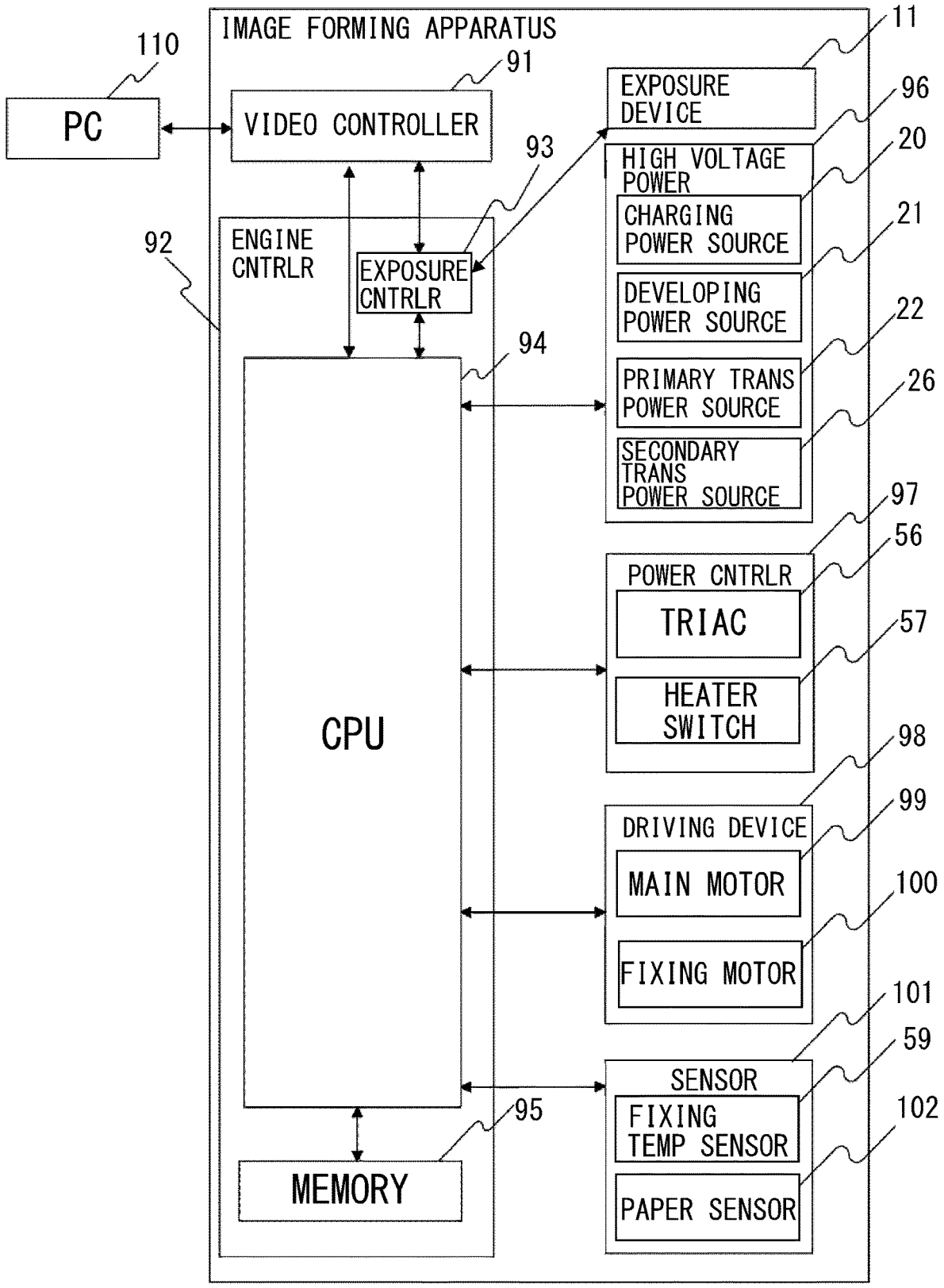
FIG. 2 is a block diagram showing a constitution of a control portion of the image forming apparatus according to the first embodiment, the second embodiment and the third embodiment.

FIG. 2 is the block diagram showing the constitution of the control portion of the image forming apparatus, and the printing operation of the image forming apparatus will be described with reference to FIG. 2. A PC 110, which is a host computer, transmits a print command which includes image data and printing information of a printing image, to a video controller 91 which is inside the image forming apparatus.

The video controller 91 converts the image data which is received from the PC 110 into exposure data and transfers it to an exposure control device 93 in an engine controller 92, while the video controller 91 transmits a print command to a CPU 94 in the engine controller 92. The exposure control device 93 is controlled by the CPU 94 and controls the exposure device 11, which turns the laser beam on and off according to the exposure data. A size of the exposure data is determined by an image size. When the CPU 94, which is a control unit, receives the print command from the video controller 91, it starts the image forming operation.

The CPU 94, a memory 95, etc., are mounted on the engine controller 92. The CPU 94 operates according to a program which is stored in the memory 95 in advance. Further, the CPU 94 includes a timer which measures time, and the memory 95 stores various information which controls the fixing device 50 which will be described below. The high voltage source 96 is constituted of the charging high voltage source 20, the developing high voltage source 21, the primary transfer high voltage source 22, and the secondary transfer high voltage source 26, which are described above. Further, a power control portion 97 includes a bidirectional thyristor 56 (hereinafter referred to as a triac), which is a supply control portion. Furthermore, the power control portion 97 also includes a heating member switching device 57, which is a switching unit which switches heating members by switching power supply path which supplies electric power. The power control portion 97 selects a heating member in which electric power is supplied in the fixing device 50 and determines an amount of electric power to supply. In the embodiment, the heating member switching device 57 is, for example, an arbeit contact relay.

A driving device 98 is constituted of a main motor 99, a fixing motor 100, etc. Further, a sensor 101 is constituted of a fixing temperature sensor 59 which is a temperature detecting unit which detects temperature of the fixing device 50, a paper sensor 102 which includes a flag and detects presence or absence of paper P, etc. and a detection result of the sensor 101 is transmitted to the CPU 94. The CPU 94 acquires the detection result of the sensor 101 and controls the exposure device 11, the high voltage source 96, the power control portion 97 and the driving device 98, based on the detection result. Thus, the CPU 94 forms an electrostatic latent image, transfers a developed toner image onto the paper P, fixes the transferred toner image on the paper P, etc. and controls an image forming process in which image data which is received from the PC 110 is printed on the paper P as a toner image. Incidentally, the image forming apparatus to which the present invention is applied is not limited to the image forming apparatus whose constitution is described in FIG. 1, however, the image forming apparatus may be an image forming apparatus which is capable of printing different widths of paper P and may be provided with the fixing device 50 which includes the heater 54 which will be described below.

[Constitution of the Fixing Device]

Next, a constitution of the fixing device 50, which controls a heating device (heater) which heats the toner image on the paper P by means of a heating member, will be described by using FIG. 3. Here, "the longitudinal direction" refers to a direction of a rotational axis of the pressing roller 53, which is substantially perpendicular to a feeding direction of the paper P which will be described below. Further, a length of the paper P in a direction (the longitudinal direction) which is substantially perpendicular to the feeding direction of the paper P is referred to as a width of paper.

Figure 3:
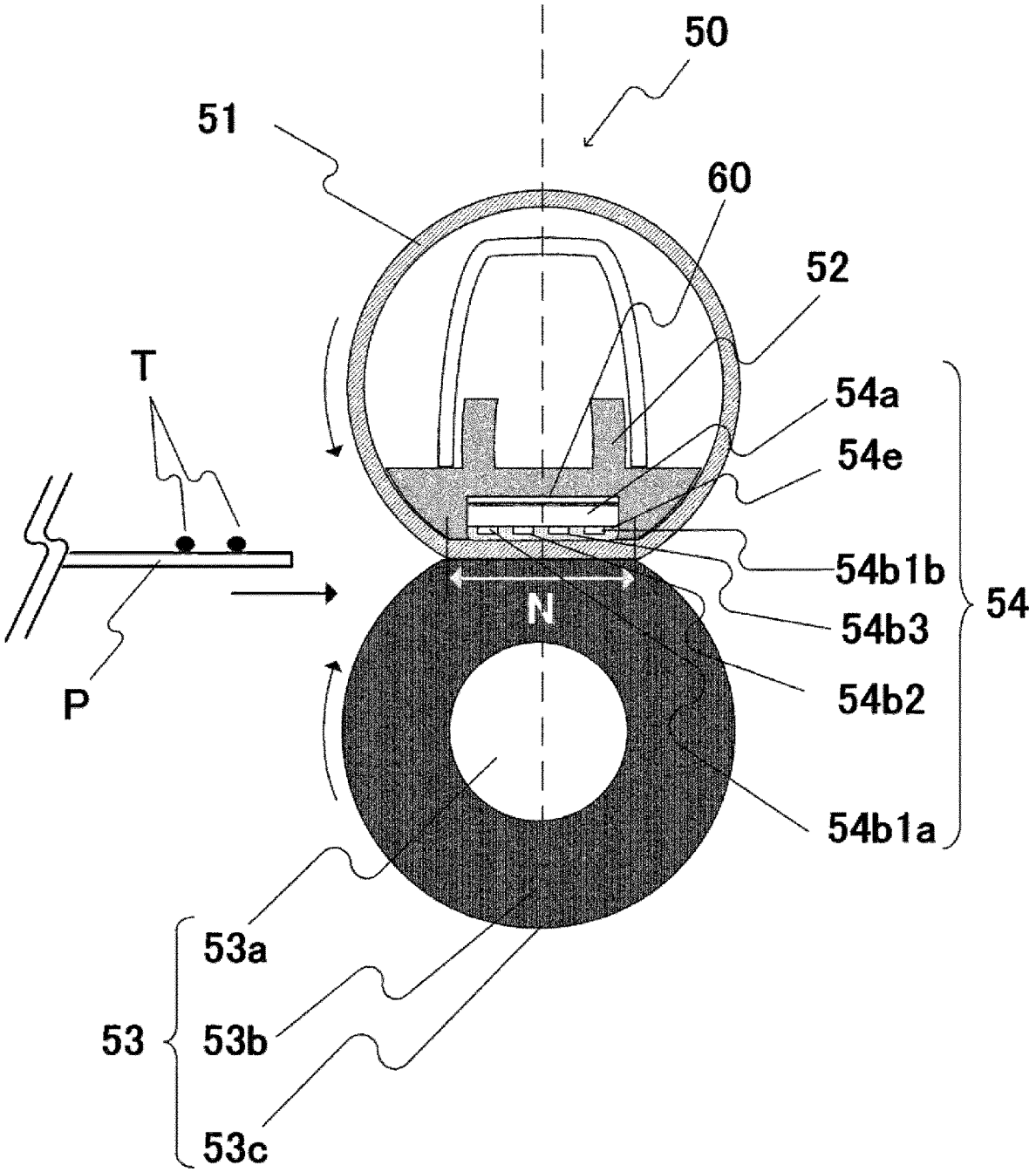
FIG. 3 is a sectional schematic view illustrating a constitution of a fixing device according to the first embodiment and the second embodiment.

FIG. 3 is the schematic sectional view illustrating the constitution of the fixing device 50. In the fixing device 50, the paper P which bears an unfixed toner image T is fed in a direction of an arrow in the figure, from a left side of the figure toward the fixing nip portion N which is constituted to abut the fixing film 51 (hereinafter referred to as "film 51") with the pressing roller 53. In the fixing nip portion N, the fixing film 51 is nipped between the pressing roller 53 and the heater 54. And while the paper P is fed from a left side to a right side in the figure in the fixing nip portion N, the paper P is heated and the toner T is fixed on the paper P. The fixing device 50 includes the cylindrical film 51, the heater holder 52 which holds the film 51, a pressing roller 53 which forms the fixing nip portion N together with the film 51, and a heater 54 (heater portion) which is a heating device which heats the paper P. Furthermore, the fixing device 50 includes an aluminum plate 60, which is a soaking member which is arranged between the heater 54 and the heater holder 52.

The film 51 is a fixing film as a rotatable heating member. The film 51 is made of polyimide, for example, as a base layer, and an elastic layer which is made of silicone rubber and a release layer which is made of PFA are formed on the base layer. An inner diameter of the film 51 is 18 mm, and an outer peripheral length of the film 51 is approximately 58 mm. Grease is applied to an inner surface of the film 51, in order to reduce frictional force between the heater holder 52 and the film 51 and between the heater 54 and the film 51, which is caused by rotation of the film 51.

The heater holder 52 guides the film 51 from an inside and at a same time forms the fixing nip portion N between the film 51 and the pressing roller 53. The heater holder 52 is a rigid, heat resistant, and heat insulating member and is formed of liquid crystalline polymer, etc. The film 51 is fitted onto the heater holder 52. The pressing roller 53 is a roller as a rotatable pressing member and constituted of a core metal 53*a*, an elastic layer 53*b*, and a release layer 53*c*. The pressing roller 53 is rotatably held at both end portions with respect to the longitudinal direction and is rotatably driven by the fixing motor 100 (FIG. 2), and the film 51 is rotated by rotation of the pressing roller 53. Incidentally, the fixing motor 100 is arranged in a front side of FIG. 3 and drives the pressing roller 53. Hereinafter, a side of the pressing roller 53 in which the fixing motor 100 is arranged is referred to as a driving side, and an opposite side of a side of the pressing roller 53 in which the fixing motor 100 is arranged is referred to as a non-driving side.

The heater 54, which is a heating member, is arranged in an inner space of the fixing film 51 and is held while one end portion of the heater 54 with respect to the longitudinal direction is abutted against the heater holder 52. A protrusion portion is formed at a position in which the heater holder 52 is abutted against the heater 54 and a longitudinal position of the heater 54 is regulated. The heater 54, which is held in the heater holder 52, contacts with the inner surface of the film 51. A heater board 54*a*, heating members 54*b*1 (54*b*1*a*, 54*b*1*b*), 54*b*2 and 54*b*3, a protective glass layer 54*e* and a fixing temperature sensor 59 (not shown in FIG. 3) will be described below.

[Overview of the Heater Portion]

Next, the heater 54, which is a heating portion, will be described. Part (a) of FIG. 4 is a schematic diagram showing a constitution of the heater 54 when the heater 54 in which heating members are arranged is viewed from a side of the pressing roller 53 which is shown in FIG. 3. In part (a) of FIG. 4, a reference line a is a center line of the heating members 54*b*1*a*, 54*b*1*b*, 54*b*2 and 54*b*3 with respect to the longitudinal direction and is also a center line of the paper P, which is fed to the fixing nip portion N of the fixing device 50, with respect to the longitudinal direction (a direction of paper width). As shown in part (a) of FIG. 4, the heater 54 includes the heater board 54*a*, the heating members 54*b*1*a*, 54*b*1*b*, 54*b*2 and 54*b*3, a conductor 54*c*, contacts from 54*d*1 through 54*d*4 and the protective glass layer 54*e*. The conductor 54*c* is a portion which is painted black in the figure. Hereinafter, the heating members 54*b*1*a*, 54*b*1*b*, 54*b*2 and 54*b*3 are collectively referred to as a heating members 54*b*.

A shape of the heater board 54*a* in the embodiment is elongated, and the heater board 54*a* is made of alumina ($Al_2O_3$) which is ceramic. Alumina ($Al_2O_3$), aluminum nitride (AlN), zirconia ($ZrO_2$), silicon carbide (SiC), etc. are widely known as ceramic board, and among them, alumina ($Al_2O_3$) is inexpensive and readily available. Further, the heater board 54*a* may be made of metal which is excellent in strength. In a case that a metal board is used, stainless steel (SUS) is excellent in price and strength and preferably used. Further, insulating layer may be provided and used for both a ceramic board and a metal board, in case that they are conductive. The heating members 54*b*1*a*, 54*b*1*b*, 54*b*2 and 54*b*3, the conductor 54*c* and the contacts from 54*d*1 through 54*d*4 are arranged on the heater board 54*a* (on the board), and in order to ensure insulation between each of the heating members and the film 51, the protective glass layer 54*e* is coated on top of them.

Positional relationships of the heating members 54*b* in the longitudinal direction will be described below. Length of each heating member in the longitudinal direction (length in a lateral direction in part (a) of FIG. 4) is different, and a length L1 of the heating members 54*b*1*a* and 54*b*1*b* in the longitudinal direction is 222 mm, a length L2 of the heating member 54*b*2 in the longitudinal direction is 188 mm and a length L3 of the heating member 54*b*3 in the longitudinal direction is 154 mm. A size relationship among the length L1, the length L2 and the length L3 in the longitudinal direction is the length L1>the length L2>the length L3. Further, each heating member is arranged in order of the heating members 54*b*1*a*, 54*b*2, 54*b*3 and 54*b*1*b* in a short direction (in a vertical direction in part (a) of FIG. 4). The heating members 54*b*1 (54*b*1*a*, 54*b*1*b*), 54*b*2 and 54*b*3 are arranged so that centers of the heating members with respect to the longitudinal direction are aligned on the heater board 54*a*. Further, largest paper width (hereinafter referred to as "maximum paper width") of the paper P which is possible to be used for the image forming apparatus in the embodiment is 216 mm, and smallest paper width (hereinafter referred to as "minimum paper width") is 76 mm. Thus, the heating member 54*b*1, whose length is the length L1 (222 mm) in the longitudinal direction, is long enough to fix the image size (206 mm) of the maximum paper width (216 mm).

As shown in part (a) of FIG. 4, the heating members 54*b*1*a* and 54*b*1*b* are electrically connected to a contact point 54*d*2 (first contact point) on one end side and to a contact point 54*d*4 (fourth contact point) on the other end side respectively via the conductor 54*c*. Further, the heating member 54*b*2 (third heating member) is electrically connected to the contact point 54*d*2 on one end side and to a contact point 54*d*3 (third contact point) on the other end side via the conductor 54*c*. Similarly, the heating member 54*b*3 (fourth heating member) is electrically connected to the contact point 54*d*1 (second contact point) on one end side and to a contact point 54*d*3 on the other end side via the conductor 54*c*. Incidentally, as shown in part (a) of FIG. 4, lengths of the heating members 54b1a and 54b1b in the longitudinal direction are same as the length L1, and the two heating members 54b1a and 54b1b are always used at a same time. Hereafter, a pair of the heating members 54b1a and 54b1b are collectively referred to as the heating member 54b1. The heating member 54b1a (first heating member) is arranged on one end portion side of the heater board 54a with respect to the short direction, and the heating member 54b1b (second heating member) is arranged on the other end portion side of the heater board 54a in the short direction. The heating members 54b2 and 54b3 are arranged symmetrically with respect to a center in the short direction between the heating members 54b1a and 54b1b in the short direction of the heater board 54a.

[Soaking Member]

In the embodiment, as shown in FIG. 3, the aluminum plate 60, which is a soaking member to equalize temperature of the heater board 54a, is arranged between the heater holder 52 and the heater 54. The aluminum plate 60 is positioned on an opposite side of the heating member 54b and the protective glass layer 54e, via the heater board 54a.

Thickness of the aluminum plate 60 is 0.3 mm, its length in the short direction is 7 mm, and its length in the longitudinal direction is 222 mm which is same length as the heating member 54b1. At one position of the aluminum plate 60 in the longitudinal direction, a positioning portion 60a (also referred to as a bending portion) which is bent toward the heater holder 52 side (see FIG. 7) is formed. The positioning portion 60a regulates a longitudinal position of the aluminum plate 60 by fitting to a recessed portion for positioning, which is formed on the heater holder 52. In the embodiment, a shape of the positioning portion 60a of the aluminum plate 60 is formed by bending the aluminum plate 60, however, it is not limited to this, and it may be formed by casting, cutting, or drawing, for example.

[Fixing Temperature Sensor]

In part (a) of FIG. 4, an area which is surrounded by a dashed line is the fixing temperature sensor 59. The dashed line indicates that the fixing temperature sensor 59 is arranged on a back side of the heater board 54a (opposite side of a surface in which the heating members 54b1, 54b2 and 54b3 are arranged) and also indicates a position in which the fixing temperature sensor 59 is abutted with the heater board 54a. A main thermistor 59a which detects temperature of the fixing temperature sensor 59, is arranged on a center line of the heating members 54b1, 54b2 and 54b3 with respect to the short direction and on the reference line a, which is a center line of the paper P which is fed to the fixing device 50.

Part (b) of FIG. 4 shows a schematic diagram showing a section of the heater 54, when it is cut at the center line of the paper P with respect to the longitudinal direction (the reference line a in part (a) of FIG. 4) which is fed to the fixing device 50. The fixing temperature sensor 59, which is a temperature detecting unit which detects the temperature of the heater 54, includes following members. That is, the fixing temperature sensor 59 includes the main thermistor 59a, a holder 59b, a ceramic paper 59c which blocks heat conduction between the holder 59b and the main thermistor 59a, and an insulating resin sheet 59d which physically and electrically protects the main thermistor 59a. The main thermistor 59a is a temperature detecting element whose resistance value changes and whose output voltage changes according to the temperature of the heater 54, and is connected to the CPU 94 by Dumet wire (not shown) and wiring. The main thermistor 59a detects the temperature of the heater 54 via the aluminum plate 60 and outputs a voltage to the CPU 94 according to the temperature of the heater 54. The CPU 94 controls the temperature of the heater 54 during a fixing process, based on a temperature detection result of the fixing temperature sensor 59 (the main thermistor 59a).

As shown in part (a) of FIG. 4, the fixing temperature sensor 59 is arranged at a position of the reference line a with regard to the longitudinal direction of the heating member 54b and contacts with the aluminum plate 60. Further, the fixing temperature sensor 59 is arranged in a center of the heater board 54a with respect to the short direction. That is, the fixing temperature sensor 59 is arranged at a substantially equal distance from the heating member 54b2 and the heating member 54b3 in the short direction. Thus, in a case that either the heating member 54b2 or the heating member 54b3 is heated, the temperature of the heater board 54a is possible to be detected, and the same applies to two of the heating members 54b1.

[Power Control Portion]

FIG. 5 is a circuit schematic diagram of a power control circuit in which a power control portion 97 of the fixing unit 50 controls a power supply from an AC power source 55 to the heater 54 which includes the heating members 54b1, 54b2 and 54b3. The power control circuit of the fixing device 50 is constituted of the triacs 56a, 56b and 56c, and the heating member switching device 57. The contact 54d1 of the heater 54 is connected to the triac 56c (third switch) and is connected to a first pole of the AC power source 55 via the triac 56c. Further, the contact 54d2 of the heater 54 is connected to the heating member switching device 57 and a second pole of the AC power source 55. Furthermore, the contact 54d3 of the heater 54 is connected to the triac 56b (second switch) and the heating member switching device 57, and is connected to the first pole of the AC power source 55 via the triac 56b. And the contact 54d4 of the heater 54 is connected to the triac 56a (first switch), and is connected to the first pole of the AC power source 55 via the triac 56a. Incidentally, by switching the power supply path with the heating member switching device 57, the heating member 54b in which electric power is supplied from the AC power source 55 is switched. Therefore, in the embodiment, "switching the electric power supply path" is also referred to as "switching the heating member 54b".

In the embodiment, the heating member switching device 57 is specifically an electromagnetic relay with a constitution of an arbeit contact. When the triacs 56a, 56b and 56c are set to be a conduction state or a non-conduction state, electric power supply or block of electric power supply from the AC power source 55 to the heating members 54b1, 54b2 and 54b3 is performed. The CPU 94 calculates an amount of electric power which is required to set the heater 54 to be predetermined temperature (target temperature which is required for fixing) based on temperature information of the heater 54 which is obtained from the main thermistor element 59a. And the CPU 94 instructs the power control portion 97 to set the conduction state/the non-conduction state of the triacs 56a, 56b and 56c. The heating member switching device 57 is set to be either a state that the contact 54d2 and the contact 54d3 are connected, or a state that the contact 54d2 and the contact 54d3 are disconnected, by setting instruction from the CPU 94 of the engine controller 92.

[Electric Power Supply Path]

Next, a method of supplying the electric power to the heating members from the AC source 55 by switching "the heating member 54b1 and the heating member 54b2" and "the heating member 54b1 and the heating member 54b3"

alternately, will be described. FIG. 6 shows a supply path in which electric power from the AC power source 55 is supplied to the circuit schematic diagram which is described in FIG. 5. In FIG. 6, in the heater 54 in which the heating members 54*b*1, 54*b*2 and 54*b*3 with three different lengths with respect to the longitudinal direction are arranged, three different electric current paths (which are both electrical paths and power supply paths) to each of the heating members 54*b*1, 54*b*2 and 54*b*3 are shown in thick solid lines. Incidentally, the current paths shown in FIG. 6 are only examples, and other current paths may be constituted.

(Power Supply to the Heating Member 54*b*1)

In a case that the electric power is supplied from the AC source 55 to the heat member 54*b*1, the electric current flows through the current paths which are shown by the thick line in part (a) of FIG. 6. The fixing temperature sensor 59 (not shown in FIG. 6) detects the temperature of the heater 54, and based on temperature information obtained from the fixing temperature sensor 59, the CPU 94 operates the triac 56*a* so that the temperature of the heater 54 becomes a predetermined temperature. In this way, the power supply from the AC power source 55 to the heating member 54*b*1 is controlled. The power supply to the heating member 54*b*1 is only required that the triac 56*a* is in the conduction state, and does not depend on the state of the triacs 56*b* and 56*c* and the state of the heating member switching device 57 (open state or short-circuit state). That is, in a case of supplying power to the heating member 54*b*1, the heating member switching device 57 may be in either the open state or the short-circuit state, and, as an example, the heating member switching device 57 is in the open state in part (a) of FIG. 6.

Further, in the embodiment, when the triacs 56*a* and 56*b* are set to be in the conduction state, the triac 56*c* is set to be in the non-conduction state and the heating member switching device 57 is set be in the open state, it is possible to supply power to the heating members 54*b*1 and 54*b*2 simultaneously from the AC power source 55. Similarly, when the triacs 56*a* and 56*c* are set to be in the conduction state, the triac 56*b* is set to be in the non-conduction state and the heating member switching device 57 is set to be in the short-circuit state, it is possible to supply power to the heating members 54*b*1 and 54*b*3 simultaneously from the AC power source 55. Further, in a case that power is supplied from the AC power source 55 only to the heating member 54*b*1, the triac 56*a* is set to be in the conduction state and the triacs 56*b* and 56*c* are set to be in the non-conduction state.

(Power Supply to the Heating Member 54*b*2)

In a case of supplying power to the heating member 54*b*2 from the AC power source 55, the electric current flows through the current path which is shown by the thick line in part (b) of FIG. 6. In the case of supplying power to the heating member 54*b*2, the triac 56*b* is set to be in the conduction state and a contact of the heating member switching device 57 is set in the open state. In the case that the heating member switching device 57 is in the open state, an impedance of the contact of the heating member switching device 57 is sufficiently greater than an impedance of the heating member 54*b*2. Therefore, the electric current from the AC power source 55 flows to the heating member 54*b*2, and almost no electric current flows to the heating member switching device 57, as a result, it is possible to heat only the heating member 54*b*2. The power which is supplied to the heating member 54*b*2 is controlled by the triac 56*b*, and in the case of supplying power only to the heating member 54*b*2, the triacs 56*a* and 56*c* are set to be the non-conducting state.

(Power Supply to the Heating Member 54*b*3)

In a case of supplying power to the heating member 54*b*3 from the AC power source 55, the electric current flows through the current path which is shown by the thick line in part (c) of FIG. 6. In the case of supplying power to the heating member 54*b*3, the triac 56*c* is set to be in the conduction state and the contact of the heating member switching device 57 is set in the short-circuit state. Therefore, almost all of the electric current from the AC power source 55 flows to the heating member 54*b*3. In the case that the heating member switching device 57 is in the short-circuit state, the impedance of the contact of the heating member switching device 57 is sufficiently smaller than the impedance of the heating member 54*b*2, so almost no electric current flows to the heating member 54*b*2, it is possible to heat only the heating member 54*b*3. The power which is supplied to the heating member 54*b*3 is controlled by the triac 56*c*, and in the case of supplying power only to the heating member 54*b*3, the triacs 56*a* and 56*b* are set to be the non-conducting state.

[Switching the Power Supply Paths]

As described above, in a case of supplying power to the heating member 54*b*1 from the AC power source 55, the heating member switching device 57 may be either in the open state or in the short-circuited state, however, in a case of supplying power to the heating member 54*b*2, the contact of the heating member switching device 57 needs to be set to be in the open state. Therefore, when switching the power supply path to the heating member 54*b*1 which is shown in part (a) of FIG. 6 (hereinafter referred to as "power supply path 1") and the power supply path to the heating member 54*b*2 which is shown in part (b) of FIG. 6 (hereinafter referred to as "power supply path 2"), the contact of the heating member switching device 57 is set to be in the open state in advance. In this way, it is possible to switch the power supply paths by controlling the triacs 56*a* and 56*b* which are non-contact switches, independently. That is, by switching the conduction state and the non-conduction state of the triacs 56*a* and 56*b* between the power supply path 1 (part (a) of FIG. 6) and the power supply path 2 (part (b) of FIG. 6), it is possible to make a seamless state transition and use the power supply path 1 and the power supply path 2 at the same time.

Further, it is also possible to switch the power supply path 1 to the heating member 54*b*1 (part (a) of FIG. 6) and a power supply path (hereinafter referred to as "power supply path 3") to the heating member 54*b*3 which is shown in part (c) of FIG. 6, as well. As described above, in the power supply path 1 which supplies power to the heating member 54*b*1, the heating member switching device 57 may be either in the open state or in the short-circuited state. On the other hand, in a case of supplying power to the heating member 54*b*3, the contact of the heating member switching device 57 needs to be set to be in the short-circuit state. Therefore, it is possible to do following things as far as the contact of the heating member switching device 57 is in the short-circuit state in advance, when switching between the power supply path 1 and the power supply path 3. That is, by switching the conduction state and the non-conduction state of the triacs 56*a* and 56*c* between the power supply path 1 (part (a) of FIG. 6) and the power supply path 3 (part (c) of FIG. 6), it is possible to make a seamless state transition and use the power supply path 1 and the power supply path 2 at the same time.

On the other hand, in a case of supplying power to the heating member 54*b*2, the contact of the heating member switching device 57 needs to be set to be in the open state, and in a case of supplying power to the heating member 54*b*3, the contact of the heating member switching device 57 needs to be set to be in the short-circuit state. Therefore, when switching the power supply path 2 (part (b) of FIG. 6) for the heating member 54*b*2 and the power supply path 3 (part (c) of FIG. 6) for the heating member 54*b*3, a state of the heating member switching device 57 needs to be switched. That is, it is possible use only one of the power supply path 2 (part (b) of FIG. 6) and the power supply path 3 (part (c) of FIG. 6), and they are exclusive. Further, unlike the triacs 56*a*, 56*b* and 56*c* which are non-contact switches, the heating member switching device 57 of the arbeit contact constitution takes time to stabilize a state, when the state of the contact is switched.

Thus, in a case of transitioning between the power supply path 2 (part (b) of FIG. 6) and the power supply path 3 (part (c) of FIG. 6), it is possible to perform as described below. For example, the state transitions may be made as from the power supply path 2 (part (b) of FIG. 6) to the power supply path 1 (part (a) of FIG. 6) to the power supply path 3 (part (c) of FIG. 6), or from the power supply path 3 (part (c) of FIG. 6) to the power supply path 1 (part (a) of FIG. 6) to the power supply path 2 (part (b) of FIG. 6). Any of the state transitions may be routed through the power supply path 1 (part (a) of FIG. 6) between the power supply path 2 (part (b) of FIG. 6) and the power supply path 3 (part (c) of FIG. 6). While the power supply path 1 (part (a) of FIG. 6) is used, that is, while the power is supplied to the heating member 54*b*1, the state of the heating member switching device 57 of the arbeit contact constitution is switched from the open state to the short-circuit state, or from the short-circuit state to the open state. By intervening the power supply path 1, a period for stabilizing the state of the heating member switching device 57 of the arbeit contact constitution, is prepared. Therefore, it is possible to avoid a situation in which necessary amount of heat to heat the paper P is not supplied due to shutdown of the power supply to the heater 54 from the AC power source 55 by the unstable state of the heating member switching device 57.

[Positioning Portion of the Soaking Member]

Here, a positional relationship of the positioning portion 60*a* with respect to the heater holder 52 for the aluminum plate 60 which is the soaking member which is a feature of the embodiment and the heating member 54*b* of the heater 54, will be described. First, a shape of the aluminum plate 60 will be described by using FIG. 7. Part (a) of FIG. 7 is a top view showing of the shape of the aluminum plate 60 when viewed from the heater holder 52 side, and an arrow on a right side indicates a direction of feeding the paper P which is described in FIG. 3. Part (b) of FIG. 7 is a side view of the aluminum plate 60 when viewed from a drive side (a side of the fixing motor 100 which drives the pressing roller 53 in FIG. 3). In part (b) of FIG. 7, a surface of the aluminum plate 60 which contacts with the heater holder 52 is a surface of an upper side in the figure, and a surface 60*b* is a contact surface which contacts with the heater board 54*a*.

In part (a) of FIG. 7, the positioning portion 60*a* fits into a recessed portion for positioning which is formed on the heater holder 52 and regulates (determines) a position of the aluminum plate 60 in the longitudinal direction. A width H1 (part (a) of FIG. 7) of the positioning portion 60*a* in the longitudinal direction is 5 mm, a height h1 (part (b) of FIG. 7) of the positioning portion 60*a* is 3 mm, and the height h1 is formed perpendicular to a contact surface 60*b*. The aluminum plate 60 is positioned in the longitudinal direction by fitting the positioning portion 60*a* into the recessed portion which is formed on the heater holder 52. Further, as described above, the position of the heater 54 in the longitudinal direction with respect to the heater holder 52 is determined by abutting the side surface of the drive side of the heater 54 with a heater abutting portion which is formed on the heater holder 52. Thus, the positional relationship between the aluminum plate 60 and the heater 54 in the longitudinal direction is regulated via the heater holder 52.

[Positional Relationship Between the Soaking Member and the Heating Members of the Heater]

FIG. 8 is a view showing a positional relationship between the heater 54 and the aluminum plate 60 in the embodiment. In FIG. 8, a figure in an upper side is a view showing arrangement position of the heating member 54*b*1 (54*b*1*a*, 54*b*1*b*), 54*b*2 and 54*b*3 of the heater 54 which is described in FIG. 4. On the other hand, a figure in a lower side is a view of the aluminum plate 60, which is arranged on a surface of an opposite side of a surface in which the heating member 54*b* of the heater 54 is arranged, when viewed from a side in which the heating member 54*b* is arranged. An area which is enclosed by a dotted line indicates a position in which the positioning portion 60*a* is provided. Incidentally, the position of the positioning portion 60*a* which is shown in FIG. 8 is an example, and as described below, at least a part of the positioning portion 60*a* is arranged within an area which corresponds to the longest heating member 54*b*1 when viewed from the heater board 54*a* in the short direction.

As described above, the heating members 54*b*1 (54*b*1*a*, 54*b*1*b*), 54*b*2 and 54*b*3 are arranged so that the centers of the heating members with respect to the longitudinal direction are aligned on the heater board 54*a*. The length of the heating members 54*b*1 (54*b*1*a*, 54*b*1*b*) in the longitudinal direction is 222 mm. A length of the heating member 54*b*2 in the longitudinal direction is 188 mm, and its end portions in the longitudinal direction is arranged so that the heating member 54*b*2 is at a position of 17 mm (=(222 mm−188 mm)/2) inside in the longitudinal direction from end portions of the heating member 54*b*1 in the longitudinal direction. Further, a length of the heating member 54*b*3 in the longitudinal direction is 154 mm, and its end portions in the longitudinal direction is arranged so that the heating member 54*b*3 is at a position of 34 mm (=(222 mm−154 mm)/2) inside in the longitudinal direction from the end portions of the heating member 54*b*1 in the longitudinal direction.

On the other hand, end portions of the aluminum plate 60 are arranged at substantially same positions as the end portions of the heating member 54*b*1. And the positioning portion 60*a* of the aluminum plate 60 is formed with a length of 5 mm in the longitudinal direction to a left direction in the figure from a position of 5 mm from the drive side end portion of the aluminum plate 60 (the right side end portion of the aluminum plate 60). That is, as shown in FIG. 8, the positioning portion 60*a* of the aluminum plate 60 is arranged at a position which corresponds to an area (the heating member 54*b*1*b* in FIG. 8) in which only the heating members 54*b*1, which are symmetrically arranged at the end portions of the heater board 54*a* in the short direction, are arranged. And the positioning portion 60*a* of the aluminum plate 60 is not arranged at positions which correspond to areas in which the heating member 54*b*2 and the heating member 54*b*3 which are not arranged at the end portion sides of the heater board 54*a* in the short direction (arranged in a center portion in the short direction). That is, the positioning portion 60*a* of the aluminum plate 60 is arranged at the position which corresponds to outside of the areas in which the heating member 54*b*2 and the heating member 54*b*3 are arranged.

Here, when a temperature gradient is formed in the short direction of the heater board 54*a*, strain is occurred in the heater board 54*a* due to difference in thermal expansion amount. Furthermore, in a case that a part of the fixing device 50 breaks down and excessive power is supplied to the heating member 54*b*, the heater board 54*a* may be deformed. The deformation of the heater board 54*a* is significant in a case that heating members (for example, the heating members 54*b*2 and 54*b*3 in the embodiment) which are not symmetrically arranged at both end portions of the heater board 54*a* in the short direction.

In a case that a heating member, which is arranged at an asymmetrical position on both end portions in the short direction with respect to a centerline of the heater board 54*a* in the short direction, generates heat, a temperature of the heater board 54*a* at the position, in which the heating member is arranged, becomes higher. On the other hand, in the end portions of the heater board 54*a* in the short direction, heat radiation amount is greater since the surface area of the heater board 54*a* is larger. This is significant at an end portion in a side of the heater board 54*a* in which a heating member which is asymmetrically arranged at both end portions of the heater board 54*a* in the short direction is not arranged. As a result, the temperature of the heater board 54*a* decreases and the temperature gradient in the short direction of the heater board 54*a* increases. Therefore, when power is supplied to heating members (the heater members 54*b*2 and 54*b*3 in the embodiment) which are arranged near a center of the heater board 54*a* in the short direction, the deformation of the heater board 54*a* is larger due to a difference of thermal expansion amount by temperature difference in the heater board 54*a*. In particular, the deformation of the heater board 54*a* is more significant in a case that a heating member is asymmetrically arranged off center of the heater board 54*a* than in a case that a heating member is arranged in a center of the heater board 54*a* in the short direction. On the other hand, when heating members (the heating members 54*b*1 in the embodiment) which are symmetrically arranged at both end portions of the heater board 54*a* in the short direction, the end portions in the short direction in which the heating members are arranged are less affected by high radiation amount, and the temperature gradient of the heater board 54*a* in the short direction is less likely to be greater.

As described above, in the embodiment, the positioning portion 60*a* of the aluminum plate 60, which is a soaking member whose thermal capacity is large and which easily absorbs heat from the heater board 54*a* is provided at a following position. That is, the positioning portion 60*a* is not arranged at a position in which the heating members 54*b*2 and 54*b*3, which are arranged at an asymmetric position with respect to a centerline of the heater board 54*a* in the short direction, are overlapped via the heater board 54*a*. And the positioning portion 60*a* is arranged at a position in which at least a part of the positioning portion 60*a* is overlapped with the heating members 54*b*1 which is symmetrically arranged at end portions of the heater board 54*a* in the short direction via the heater board 54*a*. In this way, it is possible to reduce an increase of the thermal gradient while the heating member 54*b* is heating up and suppress deformation due to strain of the heater board 54*a*.

As described above, according to the embodiment, it is possible to suppress the deformation of the heater board due to the positioning portion of the soaking member.

Second Embodiment

A power control circuit whose constitution is different from that of the first embodiment, and a heating member and a soaking member whose shapes are different from those of the first embodiment, will be described in a second embodiment. Incidentally, a constitution of the image forming apparatus which is used in the second embodiment is similar to that of the first embodiment, so same reference numerals are used for the same members and descriptions are omitted.

[Power Control Portion]

FIG. 9 is the circuit schematic view of the power control circuit in which the power control portion 97 of the fixing device 50 in the embodiment controls the power supply from the AC power source 55 to a heater 154 which includes heating members 154*b*1, 154*b*2 and 154*b*3. In FIG. 9, the heater 154 is constituted of the heater board 154*a*, the heating members 154*b*1*a*, 154*b*1*b*, 154*b*2 and 154*b*3, the conductor 154*c*, the contacts from 154*d*1 to 154*d*4 and the protective glass layer 154*e* (not shown in FIG. 9). Further, the heating members 154*b*1 (154*b*1*a*, 154*b*1*b*), 154*b*2 and 154*b*3 are arranged so that the centers of the heating members with respect to the longitudinal direction are aligned on the heater board 154*a*. Incidentally, in the embodiment, as described below, shapes of both end portions of the heating member 154*b*1 in the longitudinal direction are different from those of the first embodiment.

Further, the power control circuit of the fixing device 50 in the embodiment is constituted of triacs 156*a* and 156*b*, and a heating member switching device 157 which is a changeover contact relay. The contact 154*d*1 of the heater 154 is connected to the triac 156*b* (second switch) and a first contact of the heating member switching device 157, and is connected to the first pole of the AC power source 55 via the triac 156*b*. Further, the contact 154*d*2 of the heater 154 is connected to the heating member switching device 157 and the second pole of the AC power source 55. Furthermore, the contact 154*d*3 of the heater 154 is connected to the heating member switching device 157. And the contact 154*d*4 of the heater 154 is connected to the triac 156*a* (first switch), and is connected to the first pole of the AC power source 55 via the triac 156*a*.

In a case of supplying power to the heating member 154*b*1, power is supplied from the AC power source 55 by setting the triac 156*a* to the conduction state. In a case of supplying power to the heating member 154*b*2, power is supplied from the AC power source 55 by connecting the first contact at the heating member switching device 157 in addition to setting the triac 156*b* to the conduction state. Further, in a case of supplying power to the heating member 154*b*3, power is supplied from the AC power source 55 by connecting the second contact at the heating member switching device 157 in addition to setting the triac 156*b* to the conduction state. In this way, as shown in FIG. 9, a constitution in the embodiment is designed to connect the triac 156*a* to the heating member 154*b*1 and select the heating member 154*b*2 or the heating member 154*b*3 by the changeover contact which constitutes the heating member switching device 157.

[Constitution of Heater]

Parts (a) to (d) of FIG. 10 are enlarged views in a vicinity of a right side of the end portions of the heater 154 with respect to the longitudinal direction in the embodiment which is shown in FIG. 9, and views showing positional relationships among the heating members when standard size paper (sheet) P is passed through the fixing device 50. Part (a) of FIG. 10 is the enlarged view in the vicinity of the right side of the end portions of the heater 154 with respect to the longitudinal direction and a view showing shapes of the heating members 154*b*1*a* and 154*b*1*b*, and part (b) of FIG. 10 is a view illustrating an area in the vicinity of the end portion of the heating members 154*b*1*a* and 154*b*1*b* with respect to the longitudinal direction. Further, part (c) of FIG. 10 is the view illustrating the positional relationship when LTR paper (letter paper) is passed through the heating members 154*b*1*a* and 154*b*1*b* which are shown in part (a) of FIG. 10. And part (d) of FIG. 10 is the view illustrating the positional relationship when A4 size paper (described as A4 paper in the figure) is passed through the heating members 154*b*1*a* and 154*b*1*b* which are shown in part (a) of FIG. 10.

As shown in parts (a) and (b) of FIG. 10, in the end portions of the heating members 154*b*1*a* and 154*b*1*b* with respect to the longitudinal direction, an area with a shape whose width with respect to the short direction is gradually narrows from width H2 to width H3 is defined as area F (part (b) of FIG. 10). Further, an area adjacent to the area F, with a shape whose width with respect to the short direction gradually widens from the width H3 to the width H4, is defined as area G (part (b) of FIG. 10). And an area with a shape whose width with respect to the short direction is constant at the width H4 is defined as area H (part (b) of FIG. 10).

In the area F of the heating members 154*b*1*a* and 154*b*1*b*, the width with respect to the short direction gradually narrows toward a center with respect to the longitudinal direction from the width H2 to the width H3, and in the embodiment, the width H2 is 1.0 mm and the width H3 is 0.7 mm. Incidentally, in part (a) of FIG. 10, the width of the area F is narrowed in a straight line, however, it may be constituted to be narrowed in a curved line, for example. Further, a length L4 of the area F with respect to the longitudinal direction is 6 mm. Next, the area G will be described. In the area G of the heating member 154*b*1*a* and 154*b*1*b*, the width with respect to the short direction gradually widens toward the center with respect to the longitudinal direction, from the width H3 to the width H4, and the width H4 is 0.8 mm in the embodiment. Thus, a magnitude relationship among the widths H2, H3 and H4 is the width H2>the width H4>the width H3. Incidentally, in FIG. 10, the width of the area G is wider in a straight line, however, it may be constituted to be wider in a curved line, for example. A length L5 of the area G with respect to the longitudinal direction is 22 mm. Further, the width H4 (first length) of the area H of the heating member 154*b*1*a* with respect to the short direction is constant at 0.8 mm, and a length L6 which is from the center of the area H with respect to the longitudinal direction is 83 mm (=(222 mm/2)−6 mm−22 mm). Thus, a magnitude relationship among the lengths L4, L5 and L6 is the length L6>the length L5>the length L4. Further, as shown in part (a) of FIG. 10, the heating members 154*b*1*a* and 154*b*1*b* are symmetrical (vertically symmetrical) with respect to the center (middle) of the heater board 154*a* in the short direction, and are same dimensions as the heating member 154*b*1*a*. Furthermore, part (a) of FIG. 10 is enlarged view in the vicinity of the right side of the end portions of the heater 154 with respect to the longitudinal direction which is shown in FIG. 9, and shapes of the heating members 154*b*1*a* and 154*b*1*b* on a left side of the heater 154 with respect to the longitudinal direction, which are not shown, are symmetrical to the shapes of the right side which is shown in part (a) of FIG. 10. That is, the shapes of the heating members 154*b*1*a* and 154*b*1*b* with respect to the longitudinal direction are symmetrical shapes (bilaterally symmetrical shapes in FIG. 10) with respect to the center (middle) of the heater board 154*a* in the longitudinal direction A reason why the heating members 154*b*1*a* and 154*b*1*b* are shaped as described above is to increase an amount of heat generated per unit length (energy density P) in an order of the areas H and F, when voltage is applied to the heating members 154*b*1*a* and 154*b*1*b* from the AC power source 55. That is, when energy densities in the areas F, G and H are defined as P1, P2 and P3, respectively, magnitude relationship is to be P2>P3>P1. Here, an average value of the width of the area F with respect to the short direction (average of the width H2 and the width H3) is defined as a width H23 (third length) (=(the width H2 (1.0 mm)+the width H3 (0.7 mm))/2=0.85 mm)). Further, an average value of the width of area G with respect to the short direction (average of the width H3 and the width H4) is defined as a width H34 (second length) (=(the width H3 (0.7 mm)+the width H4 (0.8 mm))/2=0.75 mm)). In this case, in the heating members 154*b*1*a* and 154*b*1*b*, the magnitude relationship is the width H23 (0.85 mm) of the area F>the width H4 of the area H (0.8 mm)>the width of the area H34 (0.75 mm). Here, a value of electrical resistance per unit length in the area F which is an area of the most end portion side of the heating members 154*b*1*a* and 154*b*1*b* with respect to the longitudinal direction is defined as R1, a value of electrical resistance in the area G which is in a vicinity of the area F is defined as R2, and a value of electrical resistance in the area H in a center portion with respect to the longitudinal direction is defined as R3. The electrical resistance in each area is proportional to the length of the area and inversely proportional to the cross-sectional area of the area (the width with respect to the short direction in this case). Thus, a magnitude relationship among the values of the electric resistance R1, R2 and R3 is the value of the electrical resistance R2>the value of the electrical resistance R3>the value of the electrical resistance R1 and the value of the electrical resistance per unit length of each area is greater in an order of the area the area H and the area F. In this way, when voltage is applied to the heating members 154*b*1*a* and 154*b*1*b*, it is possible to increase the amount of heat generated per unit length (energy density) in the order of the areas H and F. And a magnitude relationship among the energy density in each area is the energy density P2 in the area G (amount of heat generated P2)>the energy density P3 in the area H (amount of heat generated P1)>the energy density P1 in the area F (amount of heat generated P3).

[Positional Relationship Between Paper and Heating Members]

Part (c) of FIG. 10 is a view illustrating a positional relationship between the LTR paper which is the paper P whose length is the longest with respect to the longitudinal direction and the areas F, G and H of the heating members 154*b*1*a* and 154 *b*1*b*. Further, part (d) of FIG. 10 is a view illustrating a positional relationship between the A4 paper which is the paper P whose length is the longest next to the LTR paper with respect to the longitudinal direction and the areas F, G and H of the heating members 154*b*1*a* and 154 *b*1*b*. In part (c) and part (d) of FIGS. 10, an upper portion of the paper indicates a leading end of the paper in a feeding direction, an area within 5 mm from the leading end of the paper and a right end portion in the figure is margin, and a black area other than the margin indicates an image area in which printing is performed. Incidentally, a trailing end of the paper and a left end portion of the paper in the figure are not shown and the margin of them is 5 mm. As shown in part (c) of FIG. 10, the end portions of the image area of the LTR paper with respect to the longitudinal direction are passed through the fixing nip portion N which corresponds to the area Gin which the energy density of the heating members 154*b*1*a* and 154*b*1*b* is high. In addition, as shown in FIG. 10(*d*), the heating members corresponding to the non-feed area of the fusing nip N where the longitudinal edge of the A4 paper does not pass through 154*b*1*a*, 154 *b*1*b* area F is a low energy density area. Therefore, paper non-passage portion temperature rise in a paper non-passage area (non-passage portion) of the fixing nip portion N which corresponds to the area F, is suppressed, and, in addition, it is possible to reduce temperature decrease at end portions, in which it is easier to decrease temperature at the end portions with respect to the longitudinal direction whose heat radiation amount is greater than a center portion with respect to the longitudinal direction.

[Shape of Soaking Member and Constitution of Positioning Portion]

FIG. 11 is a top view of shapes of aluminum plates 161 and 162, which are soaking members in the embodiment, when viewed from the heater holder 52 side, and an arrow on a right side indicates a feeding direction of the paper P which is shown in FIG. 3. The aluminum plate 60 which is the soaking member in the embodiment, is a single body, while the soaking member in the embodiment is constituted of two bodies of the aluminum plates 161 and 162. The aluminum plate 161 on the drive side (first soaking member) and the aluminum plate 162 on the non-drive side (second soaking member) are symmetrically arranged with respect to a center of the heater 154 of the fixing device 50 in the longitudinal direction. That is, the aluminum plate 161 is arranged on one end side of the heater 154 with respect to the longitudinal direction of the heater 154, and the aluminum plate 162 is arranged on the other end side of the heater 154 with respect to the longitudinal direction of the heater 154. End portions of opposite sides of the end portions on a center side of the aluminum plates 161 and 162 with respect to the longitudinal direction are arranged in substantially same positions as positions of both end portions of the heating member 154*b*1. A gap is provided between the aluminum plate 161 and the aluminum plate 162 to prevent them from interfering with each other when thermal expansion occurs. A positioning portion 161*a* (first positioning portion) and a positioning portion 162*a* (second positioning portion) for positioning with respect to the heater holder 152 (not shown) are formed on the aluminum plates 161 and 162, respectively. The positioning portions 161*a* and 162*a* are formed by bending an aluminum plate, for example, in a similar way to the positioning portion 60*a* in the first embodiment, and the width H1 (length) in the longitudinal direction is 5 mm and a height in a direction of the heater holder 152 is 3 mm. Positioning holes to which the positioning portions 161*a* and 162*a* which are formed on the aluminum plates 161 and 162 are fitted respectively are formed on the heater holder 152. When the positioning portions 161*a* and 162*a* of the aluminum plates 161 and 162 are fitted into the positioning holes of the heater holder 152 respectively, positions of the aluminum plates 161 and 162 in the longitudinal direction with respect to the heater holder 152 is regulated.

[Positional Relationship of Soaking Members and Heating Members of Heater]

FIG. 12 is a view showing a positional relationship between the heater 154 and the aluminum plates 161 and 162 in the embodiment. In FIG. 12, a figure in an upper side is a view showing a positional relationship among the heating members 154*b*1 (154*b*1*a*, 154*b*1*b*), 154*b*2 and 154*b*3 of the heater 154 which is described in FIG. 9. On the other hand, a figure in a lower side is a view showing the aluminum plates 161 and 162 which are arranged on a surface of an opposite side of a surface on which the heating members 154*b*1, 154*b*2 and 154*b*3 of the heater board 154 are arranged, when viewed from the side on which the heating members are arranged. Areas which are surrounded by dotted lines indicate positions in which the positioning portions 161*a* and 162*a* are provided.

The positioning portion 161*a* of the aluminum plate 161 which is arranged on the drive side is formed with a length of 5 mm toward a center with respect to the longitudinal direction in a left direction in the figure from a position of 5 mm from the drive side end portion of the aluminum plate 161 (right side end portion of the aluminum plate 161 in the figure). Further, the positioning portion 162*a* of the aluminum plate 162 which is arranged on the non-drive side is formed with a length of 5 mm toward a center with respect to the longitudinal direction in a right direction in the figure from a position of 5 mm from the non-drive side end portion of the aluminum plate 162 (left side end portion of the aluminum plate 161 in the figure).

As described above, the centers of the heating members 154*b*1 (154*b*1*a*, 154*b*1*b*), 154*b*2 and 154*b*3 with respect to the longitudinal direction are aligned and arranged on the heater board 154*a*. A length of the heating member 154*b*1 (154*b*1*a*, 154*b*1*b*) with respect to the longitudinal direction is 222 mm. A length of the heating member 154*b*2 in the longitudinal direction is 188 mm, and end portions of the heating member 154*b*2 in the longitudinal direction is arranged so that the heating member 154*b*2 is at a position of 17 mm (=(222 mm−188 mm)/2) inside in the longitudinal direction from end portions of the heating member 54*b*1 in the longitudinal direction. Further, a length of the heating member 154*b*3 in the longitudinal direction is 154 mm, and end portions of the heating member 154*b*3 in the longitudinal direction is arranged so that the heating member 154*b*3 is at a position of 34 mm (=(222 mm−154 mm)/2) inside in the longitudinal direction from the end portions of the heating member 154*b*1 in the longitudinal direction.

That is, in the embodiment, the positioning portions 161*a* and 162*a* of the aluminum plates 161 and 162 which are divided into two bodies with respect to the longitudinal direction are arranged in positions which are described below. The positioning portions 161*a* and 162*a* are not arranged at positions in which the heating members 154*b*2 and 154*b*3, which are arranged at an asymmetric position with respect to a centerline of the heater board 154*a* in the short direction, are overlapped via the heater board 154*a*. And the positioning portions 161*a* and 162*a* are arranged at positions in which at least a part of the positioning portion 161*a* and 162*a* are overlapped with the heating member 154*b*1 which is symmetrically arranged at end portions of the heater board 154*a* in the short direction via the heater board 154*a*. In this way, it is possible to reduce an increase of the thermal gradient while the heating members are heating up and suppress deformation due to strain of the heater board 154*a*.

Further, in the embodiment, when the aluminum plates 161 and 162 as soaking members which are arranged on a back side of the heater 154*a* (opposite side of a contact surface with the film 51) are not one part, but divided into two bodies (two members), advantages as described below are provided. That is, the soaking members which are arranged on the back side of the heater board 154*a* are heated by heat which is generated by the heater 154 and expands thermally. When the heater 154 finishes heating and temperature drops, the aluminum plates 161 and 162 which are the soaking members, attempt to shrink to original dimensions, however, the aluminum plates 161 and 162 are not fully returned to the original dimensions since they are strongly pressed between the heater 154 and the heater holder 152 due to pressing force of the pressing roller 53. Repeating the process may change the dimensions of the soaking members. The phenomenon is significant in a case that the soaking members are made of metal such as aluminum, whose thermal expansion amount is different from that of the heater board 154*a*. Thus, in a constitution in which the aluminum plate which is the soaking member is divided into a plurality of members, it is possible to reduce such dimensional change since thermal expansion amount is smaller.

As described above, according to the embodiment, it is possible to suppress the deformation of the heater board due to the positioning portion of the soaking member.

Third Embodiment

In the third embodiment, an embodiment in which a constitution of the heating member of the heater and a constitution of the power control circuit which are different from those in the first embodiment and the second embodiment. Incidentally, a constitution of the image forming apparatus which is used in the third embodiment is similar to that of the first embodiment, and descriptions are omitted by using same reference numerals for same members.

[Constitution of the Heater]

FIG. 13 is the circuit schematic view of the power control circuit in which the power control portion 97 of the fixing device 50 controls the power supply to the heater 254 which includes the heating members 254*b*1 (254*b*1*a*, 254*b*1*b*) and 254*b*2 from the AC power source 55. In FIG. 13, the heater 254 is constituted of the heater board 254*a*, the heating members 254*b*1*a*, 254 *b*1*b* and 254*b*2 and the conductor 254*c*, the contacts from 254*d*1 to 254*d*4 and the protective glass layer 254*e* (not shown in FIG. 13). A length L1 of the heating members 254*b*1*a* and 254*b*1*b* with respect to the longitudinal direction is 222 mm, which is similar to the heating members 54*b*1*a* and 54*b*1*b* of the first embodiment. Further, a length L2 of the heating member 254*b*2 in the longitudinal direction is 188 mm. The centers of the heating members 254*b*1 (254*b*1*a*, 254*b*1*b*) and 254*b*2 with respect to the longitudinal direction are aligned and arranged on the heater board 254*a*. Further, the heating members 254*b*1*a* and 254 *b*1*b* are arranged in a vicinity of each end portion of the heater board 254*a* with respect to the short direction, respectively. On the other hand, the heating member 254*b*2 is arranged in a center of the heater board 254*a* with respect to the short direction.

Further, shapes of the aluminum plates 261 and 262 (not shown) which are soaking members, and arrangement positions of the aluminum plates 261 and 262 on the heater board 254*a* are similar to those of the aluminum plates 161 and 162 which are soaking members in the second embodiment as described above. That is, the soaking members in the embodiment are constituted of two bodies of the aluminum plates 261 and 262. The aluminum plate 261 on the drive side and the aluminum plate 262 on the non-drive side are arranged symmetrically with respect to a center position of the heater 254 of the fixing device 50 in the longitudinal direction. A gap is provided between the aluminum plate 261 and the aluminum plate 262 to prevent interference when thermal expansion occurs. Positioning portions 261*a* and 262*a* for positioning with respect to the heater holder 252 (not shown) are formed on the aluminum plates 261 and 262, respectively. The positioning portion 261*a* of the aluminum plate 261 which is arranged on the drive side is formed with a length of 5 mm toward a center with respect to the longitudinal direction from a position of 5 mm from the drive side end portion of the aluminum plate 261. Further, the positioning portion 262*a* of the aluminum plate 262 which is arranged on the non-drive side is formed with a length of 5 mm toward a center with respect to the longitudinal direction from a position of 5 mm from the non-drive side end portion of the aluminum plate 262.

[Power Control Portion]

Further, the power control circuit of the fixing device 50 in the embodiment is constituted of a triac 256*a* (first switch) and a triac 256*b* (second switch). One terminals of the heating members 254*b*1*a*, 254*b*1*b* and 254*b*2 are connected to the contact 254*d*1 via conductor 254*c*. The other terminals of the heating members 254*b*1*a* and 254*b*1*b* (first heating member) are connected to the contact 254*d*2 via the conductor 254*c*. The other terminal of the heating member 254*b*2 (second heating member) is connected to the contact 254*d*3 via the conductor 254*c*.

The contact 254*d*1 (first contact) of the heater 254 is connected to the second pole of the AC power source 55. Further, the contact 54*d*4 of the heater 54 is connected to the triac 56*a* (first switch), and is connected to the first pole of the AC power source 55 via the triac 56*a*. Furthermore, the contact 154*d*3 (second contact) of the heater 254 is connected to the triac 256*b* (second switch) and is connected to the first pole of the AC power source 55 via the triac 256*b*.

Subsequently, in the embodiment, when each heating member is powered and heats up, temperature gradient which occurs in the heater board 254*a* will be described. In the embodiment, as shown in FIG. 13, the heating member 254*b*2 is arranged in a center of the heater board 254*a* with respect to the short direction. Therefore, when power is supplied to the heating member 254*b*2, a temperature gradient, in which temperature of the heater board 254*a* is higher in a center portion with respect to the short direction and is lower in a vicinity of end portions with respect to the short direction, is occurred. Therefore, in a case that the positioning portions 261*a* and 262*a* of the aluminum plates 261 and 262 are arranged in an area in which the heating member 254*b*2 is arranged with respect to the longitudinal direction, temperature gradient with respect to the short direction is promoted by thermal capacity of the positioning portions 261*a* and 262*a*. Then, in a case that the temperature gradient is great, the deformation of the heater board 254*a* is larger due to strain of uneven thermal expansion of the heater board 254*a*. That is, not only in a case of heating members which are arranged asymmetrically with respect to the short direction of the heater board 254*a*, but even in a case of heating members which are arranged symmetrically, the temperature gradient of the heater board 254*a* at a time of heating is larger than that in a case of the heating members which are arranged on both ends of the heater board 254*a* with respect to the short direction.

In the embodiment, positions of the positioning portions 261*a* and 262*a* of the aluminum plates 261 and 262 with respect to the longitudinal direction are not overlapped with the heating member 254*b*2 which is arranged in the center portion of the heater board 254*a* with respect to the short direction via the heater board 254*a*. And the positioning portions 261*a* and 262*a* are arranged at positions in which at least a part of the positioning portion 261*a* and 262*a* are overlapped with the heating member 254*b*1 which is symmetrically arranged at end portions of the heater board 254*a* with respect to the short direction via the heater board 254*a*.

In this way, it is possible to reduce an increase of the thermal gradient while the heating members are heating up and suppress deformation due to strain of the heater board in the embodiment.

As described above, according to the embodiment, it is possible to suppress the deformation of the heater board due to the positioning portion of the soaking member.

According to the present invention, it is possible to suppress the deformation of the heater board due to the positioning portion of the soaking member.

Other Embodiment(s)

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)?), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-137780 filed on Aug. 26, 2021, which is hereby incorporated by reference herein in its entirety.

What is claimed is:

1. A fixing device for fixing an unfixed toner image on a recording material to the recording material, the fixing device comprising:

a heater provided with an elongated substrate, a first heat generating member, a second heat generating member of which a length in a longitudinal direction of the substrate is substantially equal to a length of the first heat generating member; and a third heat generating member of which a length in the longitudinal direction is shorter than the lengths of the first heat generating member and the second heat generating member;

a soaking member configured to uniformalize a temperature of the substrate; and a holder configured to hold the heater and the soaking member, wherein the first heat generating member, the second heat generating member and the third heat generating member are arranged on the substrate, wherein, with respect to a short side direction of the substrate perpendicular to the longitudinal direction of the substrate and a thickness direction of the substrate, the first heat generating member is arranged at one end side, the second heat generating member is arranged at the other end side, and the third heat generating member is arranged between the first heat generating member and the second heat generating member;

wherein the soaking member is arranged between the heater and the holder with respect to the thickness direction of the substrate, wherein the soaking member includes a positioning portion to position the holder with respect to the longitudinal direction of the soaking member, wherein, as seen in the short side direction, the positioning portion is positioned outside of an area corresponding to the third heat generating member and at least a part of the positioning portion is positioned inside of an area corresponding to the first heat generating member.

2. A fixing device according to claim 1, wherein the soaking member is held by the holder by the positioning portion being engaged with a concave portion provided on the holder.

3. A fixing device according to claim 1, wherein the heater is provided with a fourth heat generating member of which a length in the longitudinal direction is shorter than the length of the third heat generating member, and wherein the first heat generating member, the third heat generating member, the fourth heat generating member, and the second heat generating member are arranged in this order with respect to the short side direction of the substrate.

4. A fixing device according to claim 3, wherein when an area including a center side of the first heat generating member and the second heat generating member with respect to the longitudinal direction is a first area, an area closer to an end side of the first area with respect to the longitudinal direction is a second area, and an area closer to the end side of the second area with respect to the longitudinal direction is a third area, and when a heat generation amount per unit length of the first heat generating member and the second heat generating member corresponding to the first area is a heat generation amount P1, a heat generation amount per unit length of the first heat generating member and the second heat generating member corresponding to the second area is a heat generation amount P2, and a heat generation amount per unit length of the first heat generating member and the second heat generating member corresponding to the third area is a heat generation amount P3, P2>P1>P3 is satisfied.

5. A fixing device according to claim 3, wherein when an area including a center side of the first heat generating member and the second heat generating member with respect to the longitudinal direction is a first area, an area closer to an end side of the first area with respect to the longitudinal direction is a second area, and an area closer to the end side of the second area with respect to the longitudinal direction is a third area, and when the first heat generating member and the second heat generating member corresponding to the first area has a shape of which length with respect to the short side direction is H3, the first heat generating member and the second heat generating member corresponding to the second area has a shape of which length with respect to the short side direction becomes H2, shorter than the H3, from H3 toward the third area, and the first heat generating member and the second heat generating member corresponding to the third area has a shape of which length with respect to the short side direction becomes H1, longer than the H1, from H2 toward an end portion in the longitudinal direction, and when average lengths with respect to the short side direction in the first area, the second area and the third area are a first length, a second length and a third length, respectively, the third length>the first length>the second length is satisfied.

6. A fixing device according to claim 5, wherein the shapes of the first heat generating member and the second heat generating member are symmetric with respect to a center of the substrate in the longitudinal direction and a center of the substrate in the short side direction.

7. A fixing device according to claim 6, wherein the third area is an area through which an image area on the recording material on which an image is formed does not pass.

8. A fixing device according to claim 3, wherein the heater is provided with a first contact electrically connected to one ends of the first heat generating member, the second heat generating member and the third heat generating member, a second contact electrically connected to one end of the fourth heat generating member, a third contact electrically connected to the other ends of the third heat generating member and the fourth heat generating member, and a fourth contact electrically connected to the other ends of the first heat generating member and the second heat generating member.

9. A fixing device according to claim 8, further comprising a switching unit configured to switch a power supply path from an AC power source to the first heat generating member, the second heat generating member, the third heat generating member and the fourth heat generating member, wherein the switching unit includes a first switch, a second switch, a third switch and a relay, wherein the first switch connects or disconnects the AC power source and the fourth contact, wherein the second switch connects or disconnects the AC power source and the relay, and the AC power source and the third contact, wherein the third switch connects or disconnects the AC power source and the second contact, and wherein the relay connects or disconnects the first contact and the third contact, and the AC power source and the third contact.

10. A fixing device according to claim 9, wherein the first switch, the second switch, and the third switch include a bidirectional thyristor.

11. A fixing device according to claim 10, wherein both ends of the soaking member in the longitudinal direction are arranged in the substantially same position as both ends of the first heat generating member or the second heat generating member in the longitudinal direction via the substrate.

12. A fixing device according to claim 8, further comprising a switching unit configured to switch a power supply path from an AC power source to the first heat generating member, the second heat generating member, the third heat generating member and the fourth heat generating member, wherein the switching unit includes a first switch, a second switch and a relay, wherein the first switch connects or disconnects the AC power source and the fourth contact, wherein the second switch connects or disconnects the AC power source and the relay, and the AC power source and the second contact, wherein the relay connects or disconnects the third contact and the second switch, or the AC power source and the third contact.

13. A fixing device according to claim 12, wherein the first switch and the second switch include a bidirectional thyristor.

14. A fixing device according to claim 1, wherein the heater is provided with a first contact electrically connected to one ends of the first heat generating member, the second heat generating member and the third heat generating member, a second contact electrically connected to the other end of the third heat generating member, and a third contact electrically connected to the other ends of the first heat generating member and the second heat generating member.

15. A fixing device according to claim 14, further comprising a switching unit configured to switch a power supply path from an AC power source to the first heat generating member, the second heat generating member, and the third heat generating member, wherein the switching unit includes a first switch and a second switch, wherein the first switch connects or disconnects the AC power source and the third contact, wherein the second switch connects or disconnects the AC power source and the second contact.

16. A fixing device according to claim 15, wherein the first switch and the second switch include a bidirectional thyristor.

17. A fixing device according to claim 1, wherein the soaking member includes a first soaking member and a second soaking member, and wherein the first soaking member is arranged in one end of the heater with respect to the longitudinal direction and the second soaking member is arranged in the other end of the heater with respect to the longitudinal direction.

18. A fixing device according to claim 17, wherein the first soaking member includes a first positioning portion and the second soaking member includes a second positioning portion, wherein, as seen in the short side direction, the first positioning portion of the first soaking member is positioned outside of the area corresponding to the third heat generating member and at least a part of the first positioning portion is positioned inside of the area corresponding to the first heat generating member, and wherein, as seen in the short side direction, the second positioning portion of the second soaking member is positioned outside of the area corresponding to the third heat generating member and at least a part of the second positioning portion is positioned inside of the area corresponding to the first heat generating member.

19. A fixing device according to claim 1, wherein the positioning portion is formed by bending the soaking member.

20. An image forming apparatus comprising:

an image forming unit configured to form an unfixed toner image on a recording material; and a fixing device according to claim 1, which fixes the unfixed toner image on the recording material.

21. An image forming apparatus according to claim 20, wherein the fixing device is provided with a cylindrical film configured to be heated by the heater and a pressing roller forming a nip portion in corporation with the film, wherein the heater is arranged in an internal space of the film, the heater and the pressing roller nips the film, and the image on the recording material is heated at the nip portion via the film.

* * * * *